US008821251B1

(12) United States Patent
Basallo et al.

(10) Patent No.: US 8,821,251 B1
(45) Date of Patent: Sep. 2, 2014

(54) GAMING SYSTEM AND METHOD PROVIDING PLAYS OF A GAME UNTIL OUTCOMES ASSOCIATED WITH ONE CHARACTERISTIC OUTNUMBER OUTCOMES ASSOCIATED WITH ANOTHER CHARACTERISTIC BY A DESIGNATED QUANTITY

(71) Applicant: IGT, Reno, NV (US)

(72) Inventors: Leandro Basallo, San Francisco, CA (US); Jon M. Leupp, Orinda, CA (US); Timothy L. Isaacson, Alameda, CA (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 13/784,093

(22) Filed: Mar. 4, 2013

(51) Int. Cl.
*A63F 9/24* (2006.01)
*G07F 17/32* (2006.01)

(52) U.S. Cl.
CPC ..... *G07F 17/32* (2013.01); *G07F 17/3262* (2013.01); *G07F 17/3267* (2013.01)
USPC ..... 463/20; 463/16; 463/25; 463/42

(58) Field of Classification Search
None
See application file for complete search history.

(56) References Cited

U.S. PATENT DOCUMENTS 4,560,161 A 12/1985 Hamano
4,621,814 A 11/1986 Stepan et al.
4,695,053 A 9/1987 Vazquez
4,838,552 A 6/1989 Hagiwara
5,152,529 A 10/1992 Okada
5,157,602 A 10/1992 Fields et al.
5,205,555 A 4/1993 Hamano
5,342,047 A 8/1994 Heidel
5,364,100 A 11/1994 Ludlow et al.
5,449,173 A 9/1995 Thomas et al.
5,513,846 A 5/1996 Niederlein et al.
5,536,016 A 7/1996 Thompson
5,584,763 A 12/1996 Kelly et al.
5,611,535 A 3/1997 Tiberio
5,707,286 A 1/1998 Carlson
5,722,891 A 3/1998 Inoue
5,743,526 A 4/1998 Inoue
5,769,716 A 6/1998 Saffari et al.
5,772,509 A 6/1998 Weiss et al.
5,779,544 A 7/1998 Seelig et al.
5,788,573 A 8/1998 Baerlocher et al.

(Continued)

FOREIGN PATENT DOCUMENTS

GB 2 170 636 A 8/1986
GB 2 222 712 A 3/1990

*Primary Examiner* — Dmitry Suhol
*Assistant Examiner* — Jason Yen
(74) *Attorney, Agent, or Firm* — Neal, Gerber & Eisenberg LLP

(57) ABSTRACT

Various embodiments of the present disclosure are directed to a gaming system and method providing plays of a game until outcomes associated with one characteristic outnumber outcomes associated with another characteristic by a designated quantity. In operation of one embodiment, the gaming system initiates a gaming session associated with a game. Each of a plurality of different potential outcomes of a play of the game is associated with at least one of a plurality of different characteristics. The gaming system provides plays of the game until a total quantity the outcomes of the plays of the game associated with one of the characteristics outnumber a total quantity of the outcomes of the plays of the game associated with another one of the characteristics by a designated quantity.

30 Claims, 13 Drawing Sheets

(56) References Cited

U.S. PATENT DOCUMENTS 5,823,874 A 10/1998 Adams et al.
5,848,932 A 12/1998 Adams et al.
5,902,184 A 5/1999 Bennett et al.
5,934,672 A 8/1999 Sines et al.
5,938,200 A 8/1999 Markowicz et al.
5,947,592 A 9/1999 Barlow
5,947,820 A 9/1999 Morro et al.
5,951,397 A 9/1999 Dickinson
5,954,336 A 9/1999 Goossens et al.
5,976,015 A 11/1999 Seelig et al.
5,976,051 A 11/1999 Madsack et al.
5,997,400 A 12/1999 Seelig et al.
6,015,346 A 1/2000 Bennett
6,033,307 A 3/2000 Vancura et al.
6,056,642 A 5/2000 Bennett
6,059,289 A 5/2000 Vancura et al.
6,089,976 A 7/2000 Schneider et al.
6,089,978 A 7/2000 Adams
6,093,102 A 7/2000 Bennett et al.
6,102,798 A 8/2000 Bennett
6,117,009 A 9/2000 Yoseloff
6,120,031 A 9/2000 Adams et al.
6,120,377 A 9/2000 McGinnis et al.
6,123,333 A 9/2000 McGinnis et al.
6,126,542 A 10/2000 Fier
6,146,273 A 11/2000 Olsen et al.
6,159,097 A 12/2000 Gura et al.
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,190,255 B1 2/2001 Thomas et al.
6,203,429 B1 3/2001 Demar et al.
6,224,482 B1 5/2001 Bennett
6,224,483 B1 5/2001 Mayeroff
6,231,442 B1 5/2001 Mayeroff
6,231,445 B1 5/2001 Acres
6,261,177 B1 7/2001 Bennett
6,270,412 B1 8/2001 Crawford et al.
6,302,790 B1 10/2001 Brossard
6,309,300 B1 10/2001 Glavich
6,315,664 B1 11/2001 Baerlocher et al.
6,319,123 B1 11/2001 Paludi
6,319,124 B1 11/2001 Baerlocher et al.
6,328,649 B1 12/2001 Randall et al.
6,334,814 B1 1/2002 Adams
6,336,860 B1 1/2002 Webb
6,336,863 B1 1/2002 Baerlocher et al.
6,346,043 B1 2/2002 Colin et al.
6,347,996 B1 2/2002 Gilmore et al.
6,364,767 B1 4/2002 Brossard et al.
6,398,218 B1 6/2002 Vancura
6,406,369 B1 * 6/2002 Baerlocher et al. ..... 463/20
6,428,412 B1 8/2002 Anderson et al.
6,439,995 B1 8/2002 Hughs-Baird et al.
6,450,883 B1 9/2002 O'Halloran
6,464,582 B1 10/2002 Baerlocher et al.
6,511,375 B1 1/2003 Kaminkow
6,514,141 B1 2/2003 Kaminkow et al.
6,537,152 B2 3/2003 Seelig et al.
6,554,703 B1 4/2003 Bussick et al.
6,558,254 B2 5/2003 Baelocher et al.
6,561,899 B2 5/2003 Vancura
6,561,902 B1 5/2003 Walker et al.
6,582,307 B2 6/2003 Webb
6,595,854 B2 7/2003 Hughs-Baird et al.
6,599,185 B1 7/2003 Kaminkow et al.
6,602,137 B2 8/2003 Kaminkow et al.
6,609,971 B2 8/2003 Vancura
6,609,972 B2 8/2003 Seelig et al.
6,609,973 B1 8/2003 Weiss
6,632,139 B1 10/2003 Baerlocher
6,645,074 B2 11/2003 Thomas et al.
6,663,489 B2 12/2003 Baerlocher
6,676,516 B2 1/2004 Baerlocher et al.
6,685,561 B2 2/2004 Anderson et al.
6,688,975 B2 2/2004 Baerlocher et al.
6,692,356 B2 2/2004 Baerlocher et al.
6,712,694 B1 3/2004 Nordman
6,722,981 B2 4/2004 Kaminkow et al.
6,722,982 B2 4/2004 Kaminkow et al.
6,722,983 B2 4/2004 Kaminkow et al.
6,733,386 B2 5/2004 Cuddy et al.
6,746,328 B2 6/2004 Cannon et al.
6,749,502 B2 6/2004 Baerlocher
6,749,504 B2 6/2004 Hughs-Baird
6,769,983 B2 8/2004 Slomiany
6,780,107 B2 8/2004 Baerlocher et al.
6,783,457 B2 8/2004 Hughs-Baird et al.
6,793,577 B1 9/2004 Wilkins et al.
6,796,899 B2 9/2004 Baerlocher
6,817,944 B2 11/2004 Kaminkow et al.
6,817,945 B2 11/2004 Seelig et al.
6,840,858 B2 1/2005 Adams
6,843,721 B2 1/2005 Vancura
6,843,722 B2 1/2005 Webb
6,852,028 B2 2/2005 Vancura
6,855,053 B2 2/2005 Baerlocher
6,875,108 B1 4/2005 Hughs-Baird
6,877,745 B1 4/2005 Walker et al.
6,878,061 B2 4/2005 Baerlocher et al.
6,899,618 B2 5/2005 Colin et al.
6,899,620 B2 5/2005 Kaminkow et al.
6,913,533 B2 7/2005 Cuddy et al.
6,913,535 B2 7/2005 Kaminkow et al.
6,918,834 B2 7/2005 Vancura
6,929,545 B2 8/2005 Vancura
6,929,952 B2 8/2005 Baerlocher
6,932,701 B2 8/2005 Glavich et al.
6,939,229 B2 9/2005 McClintic
6,958,013 B2 10/2005 Miereau et al.
6,964,416 B2 11/2005 McClintic et al.
6,966,833 B2 11/2005 Kaminkow et al.
7,004,834 B2 2/2006 Walker et al.
7,037,191 B2 5/2006 Rodgers et al.
7,040,983 B2 5/2006 Dolloff et al.
7,040,984 B2 5/2006 Mead
7,056,214 B2 6/2006 Miereau et al.
7,059,967 B2 6/2006 Baerlocher
7,104,888 B2 9/2006 Miereau et al.
7,112,137 B2 9/2006 Baerlocher et al.
7,121,942 B2 10/2006 Baerlocher
7,128,646 B2 10/2006 Baerlocher et al.
7,160,186 B2 1/2007 Cuddy et al.
7,160,188 B2 1/2007 Kaminkow et al.
7,172,506 B2 2/2007 Baerlocher et al.
7,182,689 B2 2/2007 Hughs-Baird et al.
7,220,180 B2 5/2007 Kaminkow et al.
7,229,350 B2 6/2007 Baerlocher et al.
7,235,011 B2 6/2007 Randall et al.
7,247,096 B2 7/2007 Vancura
7,252,591 B2 8/2007 Van Asdale
7,264,545 B2 9/2007 Maya et al.
7,273,415 B2 9/2007 Cregan et al.
7,294,055 B2 11/2007 Baerlocher et al.
7,300,348 B2 11/2007 Kaminkow et al.
7,303,469 B2 12/2007 Kaminkow
7,314,409 B2 1/2008 Maya et al.
7,316,609 B2 1/2008 Dunn et al.
7,338,364 B2 3/2008 Baerlocher et al.
7,338,367 B2 3/2008 Kaminkow et al.
7,338,369 B2 3/2008 Mierau et al.
7,341,512 B2 3/2008 Dolloff et al.
7,341,513 B2 3/2008 Cuddy et al.
7,351,141 B2 4/2008 Rodgers et al.
7,371,174 B2 5/2008 Baerlocher
7,377,849 B2 5/2008 Baerlocher et al.
7,402,103 B2 7/2008 Baerlocher
7,448,948 B2 11/2008 Hughs-Baird et al.
7,455,588 B2 11/2008 Webb et al.
7,494,412 B2 2/2009 Baerlocher

(56) References Cited

U.S. PATENT DOCUMENTS

| | | | | |
|---|---|---|---|---|
| 7,517,281 | B2 | 4/2009 | Baerlocher | |
| 7,544,129 | B2 | 6/2009 | Baerlocher | |
| 7,547,252 | B2 | 6/2009 | Peterson et al. | |
| 7,566,267 | B2 | 7/2009 | Vancura | |
| 7,566,271 | B2 | 7/2009 | Hostetler et al. | |
| 7,578,736 | B2 | 8/2009 | Baerlocher et al. | |
| 7,585,218 | B2 | 9/2009 | Mead et al. | |
| 7,591,722 | B2 | 9/2009 | Baerlocher et al. | |
| 7,601,058 | B2 | 10/2009 | Slomiany | |
| 7,666,089 | B2 | 2/2010 | Rodgers et al. | |
| 7,690,981 | B2 | 4/2010 | Ching et al. | |
| 7,726,655 | B2 | 6/2010 | Walker et al. | |
| 7,744,454 | B2 | 6/2010 | Mierau et al. | |
| 7,749,070 | B2 | 7/2010 | Baerlocher et al. | |
| 7,785,188 | B2 | 8/2010 | Cannon | |
| 7,794,320 | B2 | 9/2010 | Baerlocher et al. | |
| 7,806,760 | B2 | 10/2010 | Baerlocher | |
| 7,824,263 | B2 | 11/2010 | Baerlocher | |
| 7,833,095 | B2 | 11/2010 | Cuddy et al. | |
| 7,837,554 | B2 | 11/2010 | Kaminkow et al. | |
| 7,867,074 | B2 | 1/2011 | Gerrard et al. | |
| 7,874,908 | B2 | 1/2011 | Walker et al. | |
| 7,874,912 | B2 | 1/2011 | Cregan et al. | |
| 7,887,409 | B2 | 2/2011 | Baerlocher et al. | |
| 7,901,282 | B2 | 3/2011 | Cannon | |
| 7,914,373 | B2 | 3/2011 | Webb et al. | |
| 7,942,737 | B2 | 5/2011 | Cregan et al. | |
| 7,963,841 | B2 | 6/2011 | Baerlocher et al. | |
| 7,976,382 | B2 | 7/2011 | Benbrahim | |
| 8,210,935 | B2 | 7/2012 | Caputo et al. | |
| 2002/0052232 | A1* | 5/2002 | Kaminkow | 463/20 |
| 2004/0018868 | A1 | 1/2004 | Anderson et al. | |
| 2004/0185930 | A1 | 9/2004 | Thomas et al. | |
| 2004/0204229 | A1 | 10/2004 | Walker et al. | |
| 2005/0009595 | A1 | 1/2005 | Boyd et al. | |
| 2005/0020351 | A1 | 1/2005 | Baerlocher et al. | |
| 2005/0054435 | A1 | 3/2005 | Rodgers et al. | |
| 2005/0192081 | A1 | 9/2005 | Marks et al. | |
| 2006/0030401 | A1 | 2/2006 | Mead et al. | |
| 2006/0052157 | A1 | 3/2006 | Walker et al. | |
| 2006/0183528 | A1 | 8/2006 | Rodgers et al. | |
| 2007/0117606 | A1 | 5/2007 | Baerlocher et al. | |
| 2007/0149267 | A1 | 6/2007 | Ross et al. | |
| 2008/0020814 | A1* | 1/2008 | Kernene | 463/10 |
| 2008/0146321 | A1 | 6/2008 | Parente | |
| 2008/0188287 | A1 | 8/2008 | Schlegel et al. | |
| 2008/0200238 | A1 | 8/2008 | Mishra | |
| 2008/0272541 | A1 | 11/2008 | Walker et al. | |
| 2009/0104959 | A1 | 4/2009 | Caputo et al. | |
| 2009/0124363 | A1* | 5/2009 | Baerlocher et al. | 463/27 |
| 2009/0253492 | A1 | 10/2009 | Caputo et al. | |
| 2010/0004044 | A1 | 1/2010 | Slomiany | |
| 2010/0048282 | A1 | 2/2010 | Nicely et al. | |
| 2010/0120495 | A1* | 5/2010 | Frank et al. | 463/20 |
| 2010/0120505 | A1 | 5/2010 | Caputo et al. | |
| 2010/0120521 | A1 | 5/2010 | Caputo et al. | |
| 2011/0183750 | A1 | 7/2011 | Cregan et al. | |
| 2011/0312410 | A1* | 12/2011 | Aoki et al. | 463/25 |
| 2014/0087840 | A1* | 3/2014 | Smith et al. | 463/25 |

* cited by examiner

GAMING SYSTEM AND METHOD PROVIDING PLAYS OF A GAME UNTIL OUTCOMES ASSOCIATED WITH ONE CHARACTERISTIC OUTNUMBER OUTCOMES ASSOCIATED WITH ANOTHER CHARACTERISTIC BY A DESIGNATED QUANTITY

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming systems, an amount of a wager placed on a primary game by a player may vary. For instance, a gaming system may enable a player to wager a minimum quantity of credits, such as one credit (e.g., one penny, nickel, dime, quarter, or dollar), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot system. The gaming system generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Certain know gaming systems provide bonus gaming sessions that include a plurality of plays of a bonus game. Typically, these gaming systems sequentially provide plays of the bonus game until a termination event occurs. In one such gaming system, the termination event occurs when a designated quantity of plays of the bonus game have been provided. In another such gaming system, the termination event occurs randomly, such as upon the random generation of a termination symbol during play of a bonus slot game.

There is a continuing need to provide new, exciting, and engaging manners of determining when to terminate gaming sessions to increase player enjoyment and excitement.

SUMMARY

Various embodiments of the present disclosure are directed to a gaming system and method providing plays of a game until outcomes associated with one characteristic outnumber outcomes associated with another characteristic by a designated quantity. Generally, the gaming system initiates a gaming session associated with a game. Each of a plurality of different potential outcomes of a play of the game is associated with at least one of a plurality of different characteristics. The gaming system provides plays of the game until a total quantity of the outcomes of the plays of the game associated with one of the characteristics outnumbers a total quantity of the outcomes of the plays of the game associated with another one of the characteristics by a designated quantity.

More specifically, in operation of one embodiment, the gaming system initiates a gaming session. For a play of a game, the gaming system determines and displays one of a plurality of different outcomes. Each of a plurality of the outcomes is associated with at least one of a plurality of different characteristics, and each of the characteristics is associated with a separate counter. The gaming system determines and displays any awards associated with the displayed outcome. For each characteristic, if any, associated with the displayed outcome, the gaming system increases the counter associated with that characteristic. For each set of two of the counters, the gaming system determines a difference between the counters of the set of the counters. The gaming system determines whether the difference between the counters of any of the sets of the counters is at least a designated quantity. If the difference between the counters of any of the sets of the counters is at least the designated quantity, the gaming system ends the gaming session. If, on the other hand, none of the differences between the counters of any of the sets of the counters are at least the designated quantity, the gaming system repeats the above process for another play of the game.

In one embodiment, the game is a selection game associated with a plurality of different selections. Each of a plurality of the selections is associated with one of a plurality of different awards and at least one of a first characteristic and a second different characteristic. Upon initiation of the gaming session, the gaming system displays the selections to the player. The gaming system enables the player to pick selections and provides any awards associated with the picked selections (i.e., provides plays of the selection game in this embodiment) until a difference between a quantity of the picked selections associated with the first characteristic and a quantity of the picked selections associated with the second characteristic reaches a designated quantity.

In another embodiment, the game is a slot game associated with a plurality of reels including a plurality of symbols. The slot game is associated with a plurality of winning symbol combinations, each of which is associated with one of a plurality of different awards and at least one of a first characteristic and a second different characteristic. Upon initiation of the gaming session, the gaming system provides spins of the reels and provides any awards associated with any displayed winning symbol combinations (i.e., provides plays of the slot game in this embodiment) until a difference between a total quantity of the winning symbol combinations displayed during the gaming session that are associated with the first characteristic and a total quantity of the winning symbol combinations displayed during the gaming session that are associated with the second characteristic reaches a designated quantity.

It should thus be appreciated that the gaming system of the present disclosure is configured to provide new, exciting, and engaging manners of determining when to terminate gaming sessions, thereby increasing player enjoyment and excitement.

Additional features and advantages are described herein, and will be apparent from, the following Detailed Description and the Figures.

DETAILED DESCRIPTION

Providing Plays of a Game Until Outcomes Associated with One Characteristic Outnumber Outcomes Associated with Another Characteristic by a Designated Quantity Various embodiments of the present disclosure are directed to a gaming system and method providing plays of a game until outcomes associated with one characteristic outnumber outcomes associated with another characteristic by a designated quantity. While the credit balances, the wagers, and the awards are displayed as amounts of monetary credits or currency in the embodiments described below, one or more of such credit balances, such wagers, and such awards may be for non-monetary credits, promotional credits, and/or player tracking points or credits. Additionally, while the gaming session of the present disclosure is a bonus gaming session in the embodiments described below, it should be appreciated that in other embodiments the gaming session is a primary gaming session. Further, while the example embodiments described below employ a selection game and a slot game, it should be appreciated that any suitable game may be employed.

Figure 1:
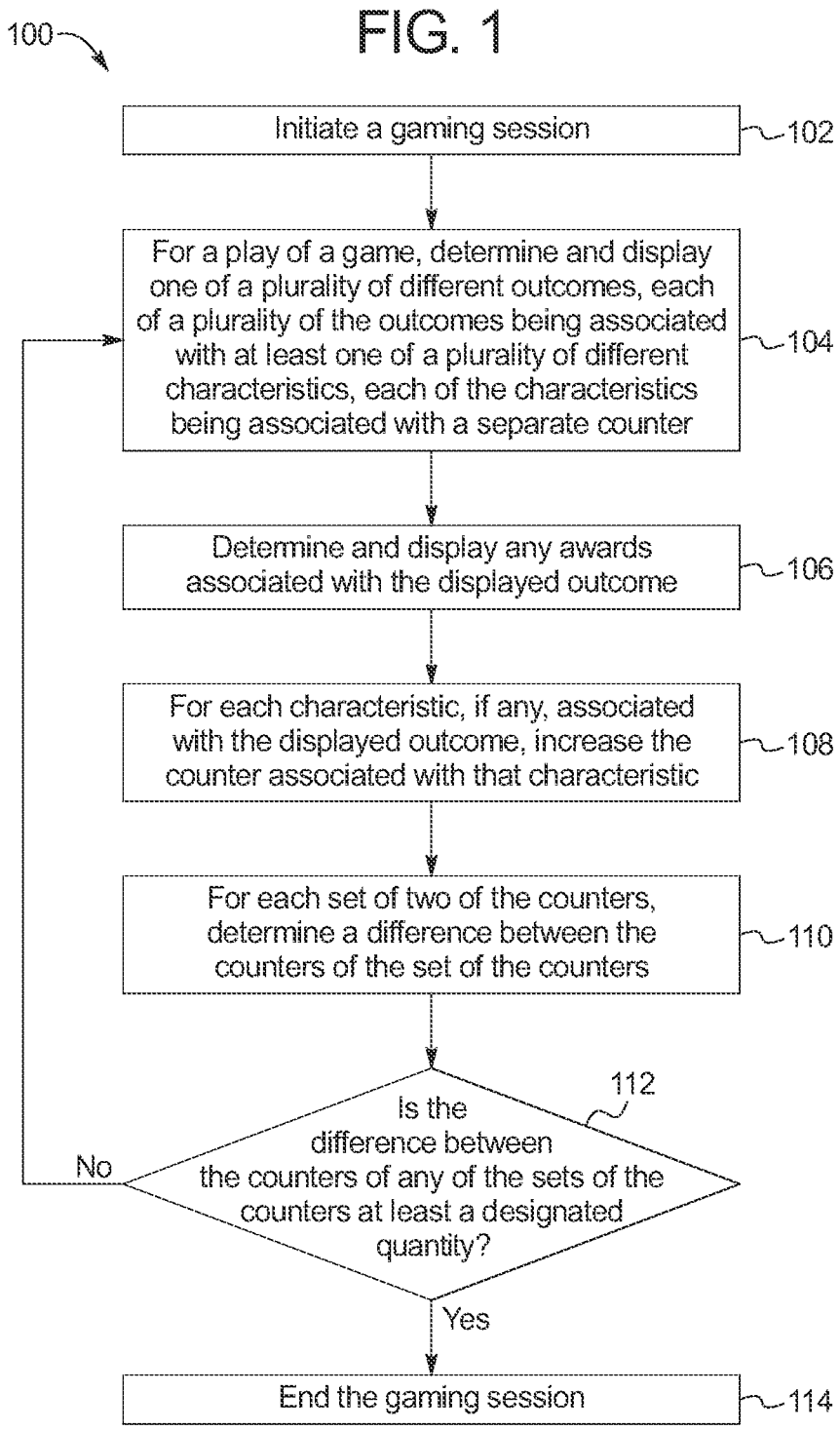
FIG. 1 is a flowchart illustrating an example method of operating the gaming system of the present disclosure.

FIG. 1 illustrates a flowchart of an example process or method 100 of operating the gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the gaming system initiates a gaming session, as indicated by block 102. For a play of a game, the gaming system determines and displays one of a plurality of different outcomes, as indicated by block 104. As also indicated by block 104, each of a plurality of the outcomes is associated with at least one of a plurality of different characteristics, and each of the characteristics is associated with a separate counter. The gaming system determines and displays any awards associated with the displayed outcome, as indicated by block 106. For each characteristic, if any, associated with the displayed outcome, the gaming system increases the counter associated with that characteristic, as indicated by block 108.

For each set of two of the counters, the gaming system determines a difference between the counters of the set of the counters, as indicated by block 110. The gaming system determines whether the difference between the counters of any of the sets of the counters is at least a designated quantity, as indicated by diamond 112. If the difference between the counters of any of the sets of the counters is at least the designated quantity, the gaming system ends the gaming session, as indicated by block 114. If, on the other hand, none of the differences between the counters of any of the sets of the counters are at least the designated quantity, process 100 returns to block 104.

FIGS. 2A, 2B, 2C, and 2D illustrate screen shots of an example embodiment of the gaming system of the present disclosure in which the gaming session is a bonus gaming session and the game is a selection game. In this example, for a first play of the selection game during the bonus gaming session, the gaming system displays (such as on display device 1116 or 1118, described below) a plurality of selections 212*a*, 212*b*, 212*c*, 212*d*, 212*e*, 212*f*, 212*g*, 212*h*, 212*i*, 212*j*, 212*k*, 212*l*, 212*m*, 212*n*, 212*o*, 212*p*, 212*q*, 212*r*, 212*s*, 212*t*, 212*u*, 212*v*, 212*w*, 212*x*, 212*y*, 212*z*, 212*aa*, 212*bb*, 212*cc*, and 212*dd*. Each of the selections is associated with: (a) one of a plurality of different awards; and (b) one of a first characteristic, which is an "X" in this illustrated example, and a second different characteristic, which is an "O" in this illustrated example. In this example, the gaming system hides the award and the characteristic with which each selection is associated until the gaming system receives a pick of that selection (as described below). However, in other embodiments, the gaming system does not hide at least one of the award and the characteristic associated with at least one of the selections prior to that selection being picked.

In this example, each characteristic is associated with a same quantity of the selections (i.e., the "X" and the "O" are each associated with fifteen of the selections). It should be appreciated, however, that in other embodiments at least two characteristics are associated with different quantities of the outcomes.

Additionally, in this example, the sum of the awards associated with the selections associated with the respective characteristics is the same (i.e. the sum of the awards for the selections associated with the "X" is equal to the sum of the awards for the selections associated with the "O"). It should be appreciated, however, that in other embodiments the sums of the awards associated with the outcomes associated with at least two of the characteristics are not equal.

In operation of this example, the gaming system enables the player to sequentially pick selections (i.e., provides sequential plays of the selection game) until one of: (a) a quantity of the picked selections associated with the "X" outnumbers a quantity of the picked selections associated with the "O" by three, and (b) the quantity of the picked selections associated with the "O" outnumbers the quantity of the picked selections associated with the "X" by three. When the quantity of picked selections associated with the "X" outnumbers the quantity of picked selections associated with the "O" by three, or vice-versa, the gaming system ends the bonus gaming session.

The gaming system displays a scale 230 that functions as a counter for both the "X" and the "O." That is, scale 230 separately tracks the quantity of the picked selections associated with the "X" and the quantity of the picked selections associated with the "O," As will be explained further below, in this example, when the gaming system receives a pick of one of the selections associated with the "X," the gaming system displays a representation of the "X" on the left hand side of scale 230 and displays a corresponding tilt of scale 230 to the left. In other words, when the gaming system receives a pick of one of the selections associated with the "X," the gaming system increases the counter associated with the "X" by one. Conversely, when the gaining system receives a pick of one of the selections associated with the "O," the gaming system displays a representation of the "O" on the right hand side of scale 230 and a corresponding tilt of scale 230 to the right. In other words, when the gaming system receives a pick of one of the selections associated with the "O," the gaming system increases the counter associated with the "O" by one.

The gaming system ends the bonus gaming session when one of: (a) the gaming system adds a representation of the "X" to the left side of the scale such that there are three more representations of the "X" displayed on the left side of the scale than there are representations of the "O" displayed on the right side of the scale, and (b) the gaming system adds a representation of the "O" to the right side of the scale such that there are three more representations of the "O" displayed on the right side of the scale than there are representations of the "X" displayed on the left side of the scale. Put differently, the gaming system ends the bonus gaming session when one of the counters increases such that the difference between the counters is equal to three.

It should be appreciated that the gaming system may display the counters associated with the characteristics in any suitable manner. In one embodiment, each counter is a number. For example, if the player has picked seven selections associated with the "X" and five selections associated with the "O," the counter associated with the "X" displays "7" and the counter associated with the "O" displays "5." In another embodiment, each counter is a bar graph or a line graph. In another embodiment, rather than displaying separate counters for the characteristics, the gaming system displays a difference counter the displays the largest difference between the counters of all of the sets of counters. For example, if the player has picked seven selections associated with the "X" and five selections associated with the "O," the difference counter displays "2." In another embodiment, each counter includes a color gradient that varies from one color to another color depending on how many selections associated with the characteristic associated with that counter have been picked. For example, if the player has picked zero selections associated with the "X" at a first point in time, the counter associated with the "X" is blue, and if the player has picked seven selections associated with the "X" at a second point in time, the counter associated with the "X" is red. In other embodiments, the gaming system does not display the counters. That is, in this embodiment, the gaming system maintains the counters without displaying them to the player at one or more points during game play.

The gaming system also displays a plurality of displays or meters including: a current selection award meter 270 that displays any award associated with the most recently picked selection; a total bonus award meter 280 that displays a total of any awards provided during the bonus gaming session; and a message box 260 that displays messages or indications before, during, or after the bonus gaming session. While in this illustrated example the gaming system displays any awards provided to the player in the form of amounts of credits, it should be appreciated that such indications may alternatively or additionally be made in the form of amounts of currency.

Figure 2A:
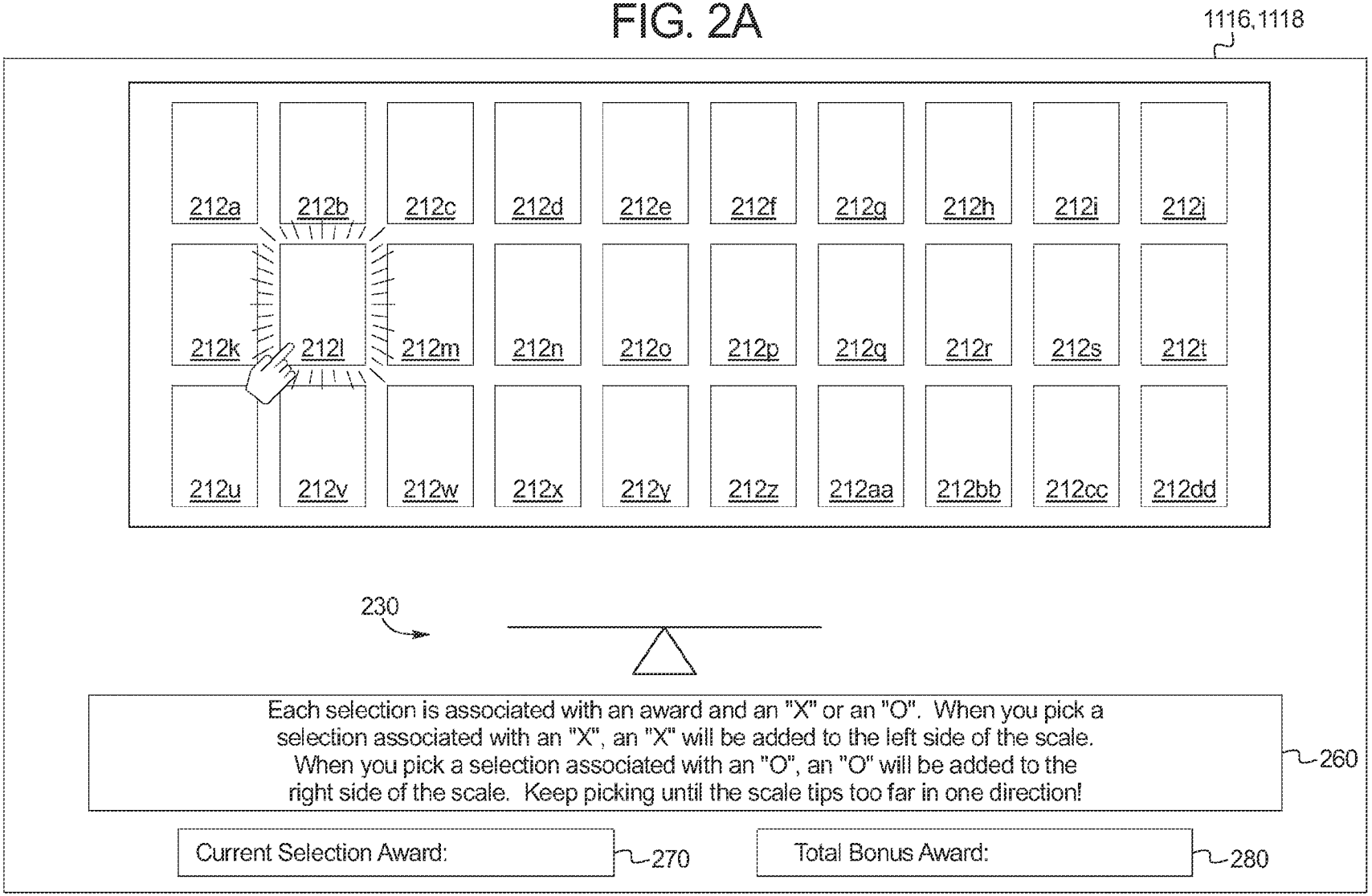
FIGS. 2A, 2B, 2C, and 2D illustrate screen shots of an example embodiment of the gaming system of the present disclosure configured to provide a bonus gaming session including a plurality of plays of a selection game.

As illustrated in FIG. 2A, upon initiation of the bonus gaming session in this example, the gaming system provides a first play of the selection game and receives a pick of selection 212*l*. The gaming system displays the following message in message box 260: "EACH SELECTION IS ASSOCIATED WITH AN AWARD AND AN "X" OR AN "O." WHEN YOU PICK A SELECTION ASSOCIATED WITH AN "X," AN "X" WILL BE ADDED TO THE LEFT SIDE OF THE SCALE. WHEN YOU PICK A SELECTION ASSOCIATED WITH AN "O," AN "O" WILL BE ADDED TO THE RIGHT SIDE OF THE SCALE. KEEP PICKING UNTIL THE SCALE TIPS TOO FAR IN ONE DIRECTION!"

Figure 2B:
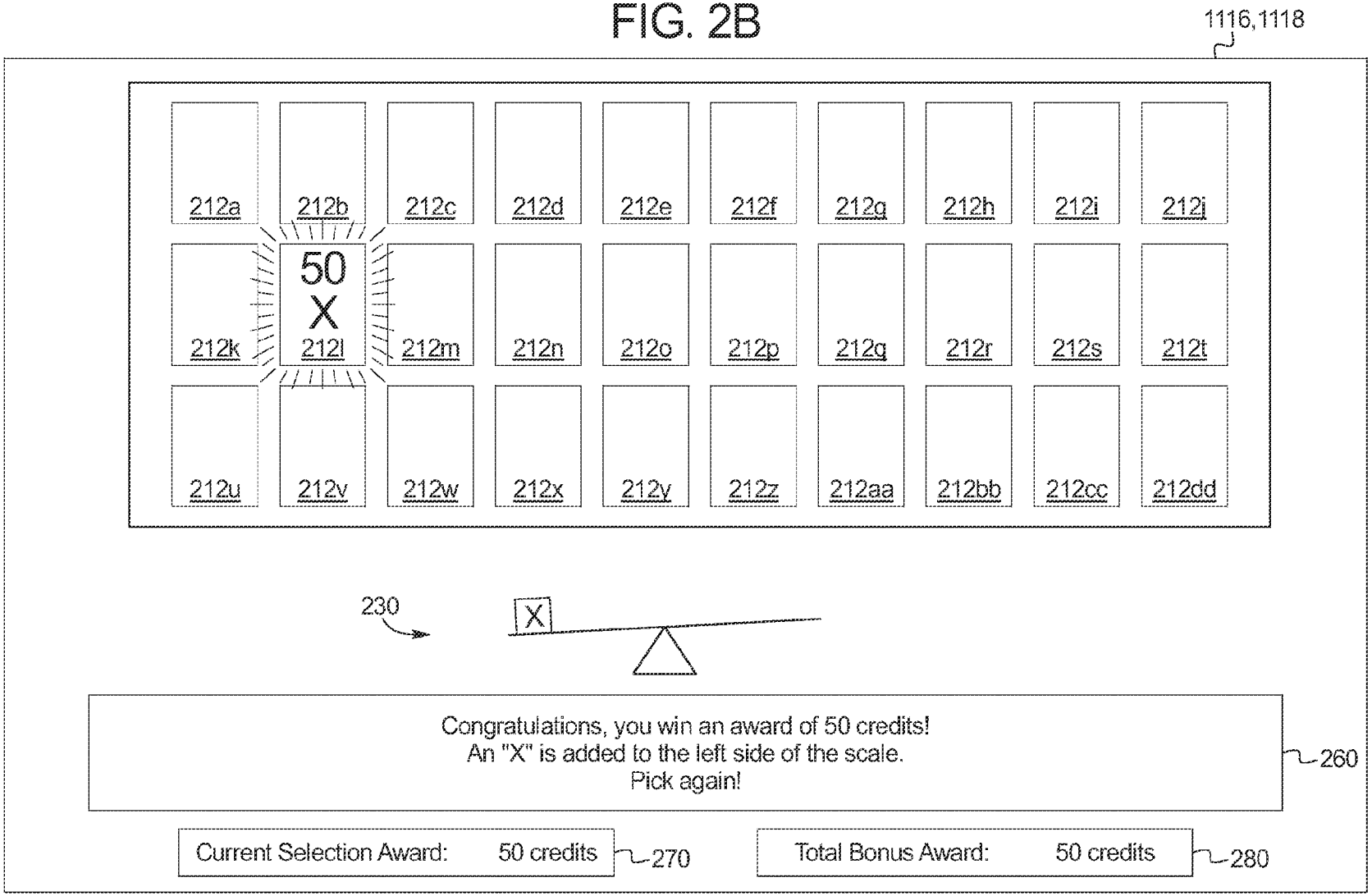

As illustrated in FIG. 2B, the gaming system displays an outcome of the play of the selection game and, more specifically, reveals an award of 50 credits associated with picked selection 212*l* and that picked selection 212*l* is associated with the "X." Thus, the outcome of this play of the selection game is associated with the "X." The gaming system displays the 50 credit award in current selection award meter 270 and updates total bonus award meter 280 to reflect the 50 credit award. Since picked selection 212*l* is associated with the "X," the gaming system displays a representation of the "X" on the left side of scale 230 and displays a corresponding tilt of scale 230 to the left. In other words, the gaming system increases the counter associated with the "X" by one. The gaming system determines that there are not three more displayed representations of the "X" than there are displayed representations of the "O" and that there are not three more displayed representations of the "O" than there are displayed representations of the "X." Put differently, the gaming system determines that the difference between the counters is not equal to three Thus, the gaming system provides another play of the selection game. The gaming system displays the following message in message box 260; "CONGRATULATIONS, YOU WIN AN AWARD OF 50 CREDITS! AN "X" IS ADDED TO THE LEFT SIDE OF THE SCALE. PICK AGAIN!"

Figure 2C:
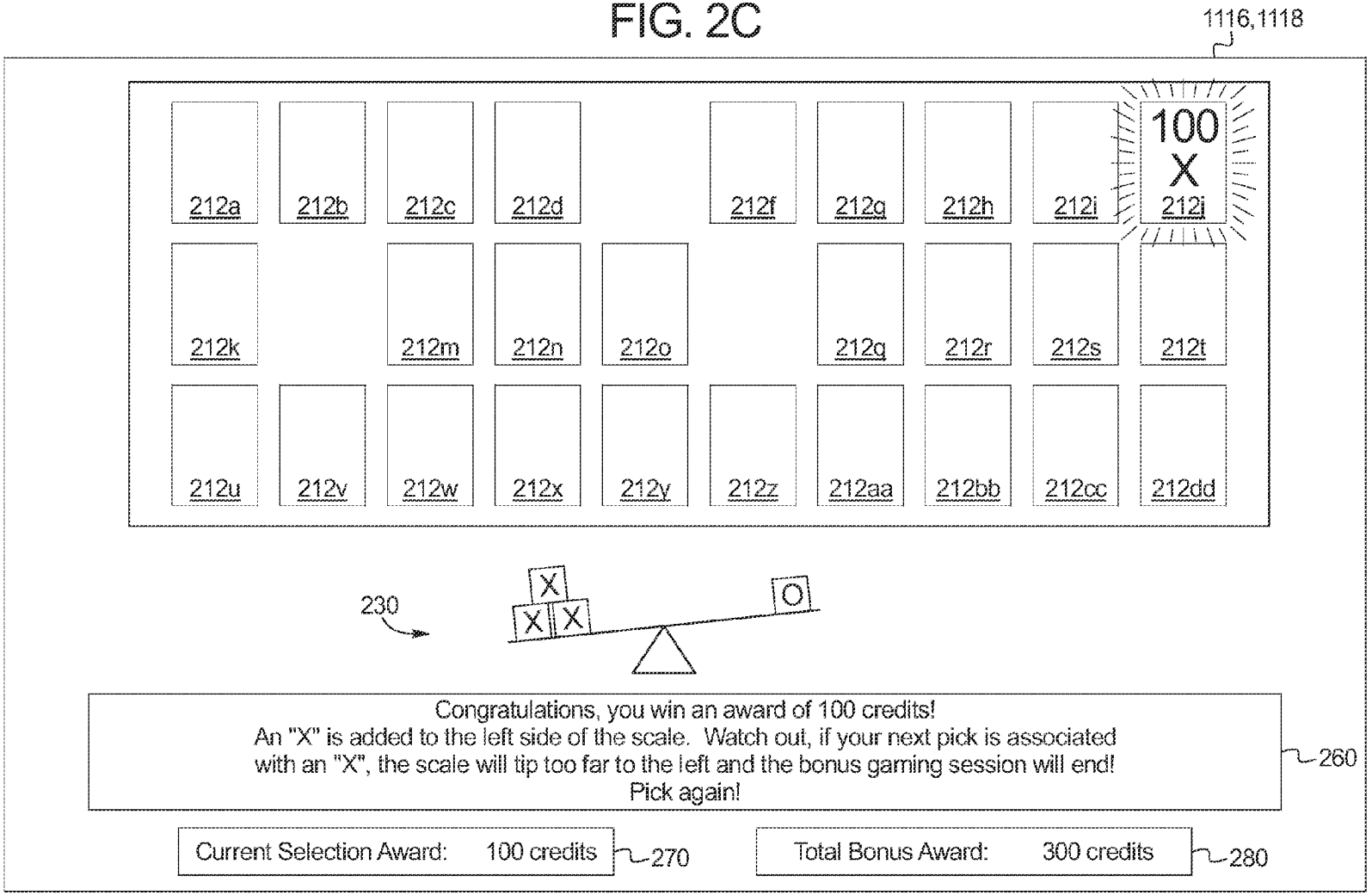

FIG. 2C illustrates a screen shot of the gaming system at a subsequent point in time during the bonus gaming session after the gaming system has provided two additional plays of the selection game. More specifically, at this point in time, the gaming system has: (a) removed picked selection 212*l*; (b) received picks of selections 212*e* and 212*p*, one of which was associated with the "X" and the other of which was associated with the "O"; (c) displayed a representation of the "X" on the left side of scale 230 (i.e., increased the counter associated with the "X" by one) and a representation of the "O" on the right side of scale 230 (i.e., increased the counter associated with the "O" by one); and (d) removed picked selections 212*e* and 212*p*. The gaming system determined that there were not three more displayed representations of the "X" than there were displayed representations of the "O" and that there were not three more displayed representations of the "O" than there were displayed representations of the "X." Put differently, the gaming system determined that the difference between the counters was not equal to three Thus, the gaming system provides another play of the selection game in which the gaming system receives a pick of selection 212*j* and displays an outcome for the play of the selection game. More specifically, the gaming system reveals an award of 100 credits associated with picked selection 212*j* and that picked selection 212*j* is associated with the "X." Thus, the outcome of this play of the selection game is associated with the "X." The gaming system displays the 100 credit award in current selection award meter 270 and updates total bonus award meter 280 to reflect the 100 credit award. Since picked selection 212*j* is associated with the "X," the gaming system displays a representation of the "X" on the left side of scale 230 and displays a corresponding tilt of scale 230 to the left. In other words, the gaming system increases the counter associated with the "X" by one. The gaming system determines that there are not three more displayed representations of the "X" than there are displayed representations of the "O" and that there are not three more displayed representations of the "O" than there are displayed representations of the "X." Put differently, the gaming system determines that the difference between the counters is not equal to three. Thus, the gaming system provides another play of the selection game. The gaming system displays the following message in message box 260: "CONGRATULATIONS, YOU WIN AN AWARD OF 100 CREDITS! AN "X" IS ADDED TO THE LEFT SIDE OF THE SCALE. WATCH OUT, IF YOUR NEXT PICK IS ASSOCIATED WITH AN "X," THE SCALE WILL TIP TOO FAR TO THE LEFT AND THE BONUS GAMING SESSION WILL END! PICK AGAIN!"

Figure 2D:
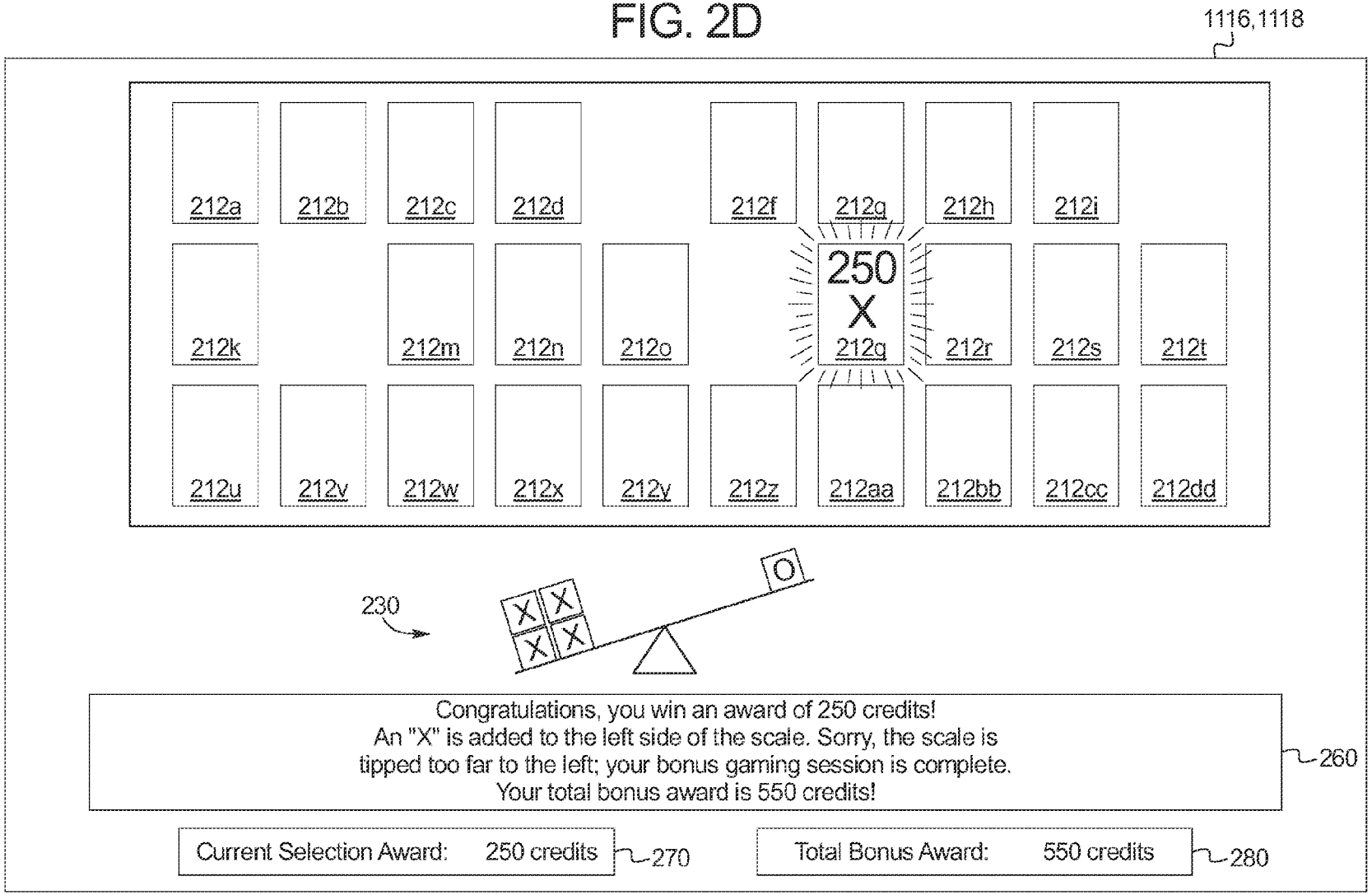

As illustrated in FIG. 2D, the gaming system removes picked selection 212*j* and provides another play of the selection game in which the gaming system receives a pick of selection 212*q* and displays an outcome for the play of the selection game. More specifically, the gaming system reveals an award of 250 credits associated with picked selection 212*q* and that picked selection 212*q* is associated with the "X." Thus, the outcome of this play of the selection game is associated with the "X". The gaming system displays the 250 credit award in current selection award meter 270 and updates total bonus award meter 280 to reflect the 250 credit award. Since picked selection 212*q* is associated with the "X," the gaming system displays a representation of the "X" on the left side of scale 230 and displays a corresponding tilt of scale 230 to the left. In other words, the gaming system increases the counter associated with the "X" by one. The gaming system determines that there are three more displayed representations of the "X" than there are displayed representations of the "O." Put differently, the gaming system determines that the difference between the counters is equal to three. Therefore, the gaming system ends the bonus gaming session. The gaming system displays the following message in message box 260: "CONGRATULATIONS, YOU WIN AN AWARD OF 250 CREDITS! AN "X" IS ADDED TO THE LEFT SIDE OF THE SCALE. SORRY, THE SCALE IS TIPPED TOO FAR TO THE LEFT; YOUR BONUS GAMING SESSION IS COMPLETE. YOUR TOTAL BONUS AWARD IS 550 CREDITS!"

FIGS. 3A, 3B, 3C, and 3D illustrate screen shots of another example embodiment of the gaming system of the present disclosure in which the gaming session is a bonus gaming session and the game is a slot game. In this example, the gaming system displays a plurality of reels 305*a*, 305*b*, and 305*c*, each of which includes a plurality of symbols. The gaming system also displays a plurality of symbol display areas 310*a*, 310*b*, 310*c*, 310*d*, 310*e*, 310*f*, 310*g*, 310*h*, and 310*i*. Each of the reels is associated with a plurality of the symbol display areas such that, following a spin of the reels, each reel is configured to display one of the symbols on that reel at each of the symbol display areas with which that reel is associated. In this example, reel 305*a* is associated with, and configured to display symbols at, symbol display areas 310*a*, 310*d*, and 310*g*; reel 305*b* is associated with, and configured to display symbols at, symbol display areas 310*b*, 310*e*, and 310*h*; and reel 305*c* is associated with, and configured to display symbols at, symbol display areas 310*c*, 310*f*, and 310*i*.

The gaming system displays a plurality of paylines for the slot game. Each of the paylines is associated with a different plurality of the symbol display areas. Specifically, payline 315*a* is associated with symbol display areas 310*a*, 310*b*, and 310*c*; payline 315*b* is associated with symbol display areas 310*d*, 310*e*, and 310*f*; and payline 315*c* is associated with symbol display areas 310*g*, 310*h*, and 310*i*.

The gaming system displays a paytable 390 for the slot game. Paytable 390 includes a plurality of winning symbol combinations. Each of the winning symbol combinations is associated with an award and one of a first characteristic, which is a "high value" characteristic, and a second different characteristic, which is a "low value" characteristic. Specifically, winning symbol combination SEVEN-SEVEN-SEVEN is a "high value" winning symbol combination associated with an award of 1,000 credits; winning symbol combination TRIPLE BAR-TRIPLE BAR-TRIPLE BAR is a "high value" winning symbol combination associated with an award of 500 credits; winning symbol combination DOUBLE BAR-DOUBLE BAR-DOUBLE BAR is a "high value" winning symbol combination associated with an award of 100 credits; winning symbol combination TRIPLE CHERRY-TRIPLE CHERRY-TRIPLE CHERRY is a "low value" winning symbol combination associated with an award of 50 credits; winning symbol combination BAR-BAR-BAR is a "low value" winning symbol combination associated with an award of 20 credits; and whining symbol combination CHERRY-CHERRY-CHERRY is a "low value" winning symbol combination associated with an award of 10 credits.

In operation of this example, the gaming system provides spins of the reels (i.e., provides plays of the slot game) until one of: (a) a total quantity of the "high value" winning symbol combinations generated and displayed during the gaming session outnumbers a total quantity of the "low value" winning symbol combinations generated and displayed during the gaming session by three, and (b) the total quantity of the "low value" winning symbol combinations generated and displayed during the gaming session outnumbers the total quantity of the "high value" winning symbol combinations generated and displayed during the gaming session by three.

When the total quantity of the "high value" winning symbol combinations generated and displayed during the gaming session outnumbers the total quantity of the "low value" winning symbol combinations displayed generated and during the gaming session by three, or vice-versa, the gaming system ends the bonus gaming session.

The gaming system displays a scale 330 that functions as a counter for both the "high value" characteristic and the "low value" characteristic. That is, scale 330 separately tracks the total quantity of the "high value" winning symbol combinations generated and displayed during the gaming session and the total quantity of the "low value" winning symbol combinations generated and displayed during the gaming session. As will be explained further below, in this example, when the gaming system displays one of the "high value" winning symbol combinations, the gaming system displays a representation of the "high value" characteristic on the right hand side of scale 330 and displays a corresponding tilt of scale 330 to the right. In other words, when the gaming system displays one of the "high value" winning symbol combinations, the gaming system increases the counter associated with the "high value" characteristic by one. When the gaming system displays one of the "low value" whining symbol combinations, the gaming system displays a representation of the "low value" characteristic on the left hand side of scale 330 and a corresponding tilt of scale 330 to the left. In other words, when the gaming system displays one of the "low value" winning symbol combinations, the gaming system increases the counter associated with the "low value" characteristic by one.

The gaming system ends the bonus gaming session when one of: (a) the gaming system adds a representation of the "high value" characteristic to the right side of the scale such that there are three more representations of the "high value" characteristic displayed on the right side of the scale than there are representations of the "low value" characteristic displayed on the left side of the scale, and (b) the gaming system adds a representation of the "low value" characteristic to the left side of the scale such that there are three more representations of the "low value" characteristic displayed on the left side of the scale than there are representations of the "high value" characteristic displayed on the right side of the scale. Put differently, the gaming system ends the bonus gaming session when one of the counters increases such that the difference between the counters is equal to three.

The gaming system also displays a plurality of displays or meters including: a current selection award meter 370 that displays any award associated with the most recent spin of the reels; a total bonus award meter 380 that displays a total of any awards provided during the bonus gaming session; and a message box 360 that displays messages or indications before, during, or after the bonus gaming session. While in this illustrated example the gaming system displays any awards provided to the player in the form of amounts of credits, it should be appreciated that such indications may alternatively or additionally be made in the form of amounts of currency.

Figure 3A:
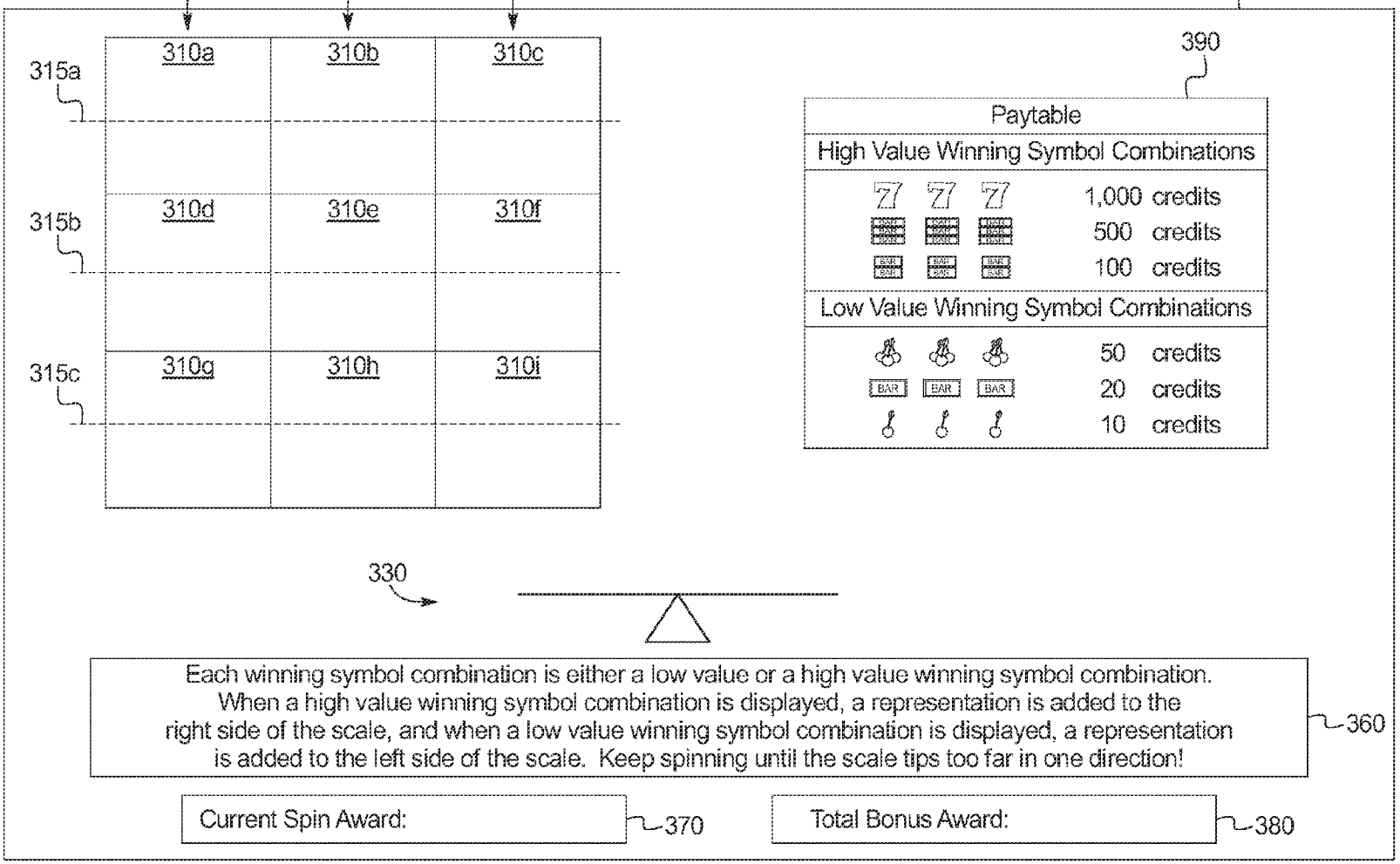
FIGS. 3A, 3B, 3C, and 3D illustrate screen shots of an example embodiment of the gaming system of the present disclosure configured to provide a bonus gaming session including a plurality of plays of a slot game.

As illustrated in FIG. 3A, upon initiation of the bonus gaming session in this example, the gaming system displays the following message in message box 360: "EACH WINNING SYMBOL COMBINATION IS EITHER A LOW VALUE OR A HIGH VALUE WINNING SYMBOL COMBINATION, WHEN A HIGH VALUE WINNING SYMBOL COMBINATION IS DISPLAYED, A REPRESENTATION OF THE HIGH VALUE CHARACTERISTIC IS ADDED TO THE RIGHT SIDE OF THE SCALE, AND WHEN A LOW VALUE WINNING SYMBOL COMBINATION IS DISPLAYED, A REPRESENTATION OF THE LOW VALUE CHARACTERISTIC IS ADDED TO THE LEFT SIDE OF THE SCALE. KEEP SPINNING UNTIL THE SCALE TIPS TOO FAR IN ONE DIRECTION!"

Figure 3B:
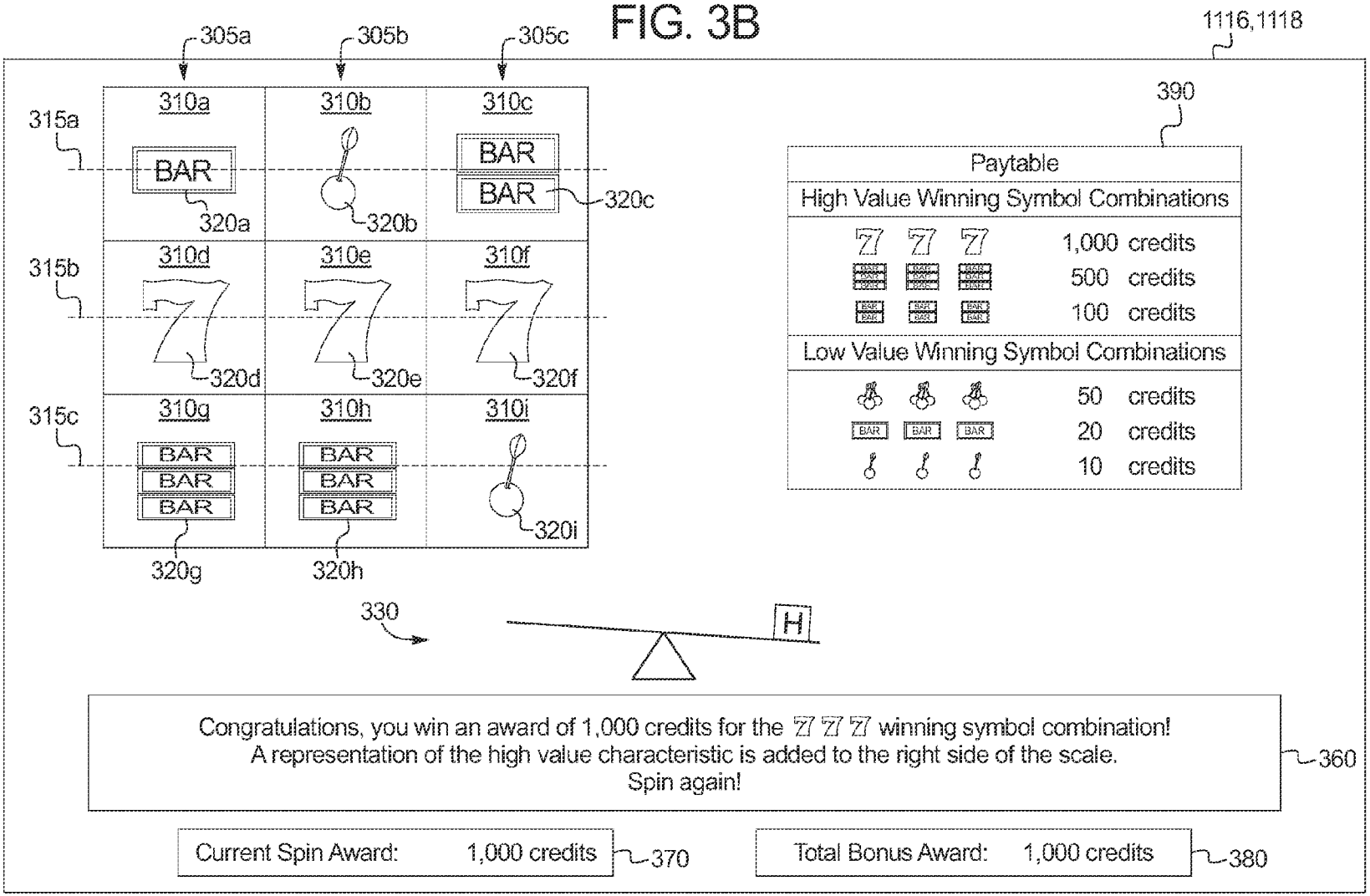

As illustrated in FIG. 3B, the gaming system provides a first play of the slot game in which the gaming system spins and stops the reels to provide an outcome. More specifically, the gaming system spins and stops the reels such that: Bar symbol 320*a* is displayed at symbol display area 310*a*, Cherry symbol 320*b* is displayed at symbol display area 310*b*, Double Bar symbol 320*c* is displayed at symbol display area 310*c*, Seven symbol 320*d* is displayed at symbol display area 310*d*, Seven symbol 320*e* is displayed at symbol display area 310*e*, Seven symbol 320*f* is displayed at symbol display area 310*f*, Triple Bar symbol 320*g* is displayed at symbol display area 310*g*, Triple Bar symbol 320*h* is displayed at symbol display area 310*h*, and Cherry symbol 320*i* is displayed at symbol display area 310*i*.

The gaming system makes an award determination based on the displayed outcome and, more specifically, determines whether any of the symbols displayed at the symbol display areas associated with any of paylines 315*a*, 315*b*, and 315*c* form any of the winning symbol combinations. The gaming system determines that Seven symbol 320*d*, Seven symbol 320*e*, and Seven symbol 320*f*, which are respectively displayed at symbol display areas 310*d*, 310*e*, and 310*f* associated with payline 315*b*, form the "high value" Seven-Seven-Seven winning symbol combination. Accordingly, the gaming system displays the 1,000 credit award associated with the displayed Seven-Seven-Seven winning symbol combination in current spin award meter 370 and updates total bonus award meter 380 to reflect the 1,000 credit award. Since the displayed Seven-Seven-Seven winning symbol combination is a "high value" winning symbol combination, the gaming system determines that the outcome of this play of the slot game is associated with the "high value" characteristic.

Because the outcome of this play of the game includes one "high value" winning symbol combination, the gaming system displays a representation of the "high value" characteristic on the right side of scale 330 and displays a corresponding tilt of scale 330 to the right. In other words, the gaming system increases the counter associated with the "high value" characteristic by one. The gaming system determines that there are not three more displayed representations of the "high value" characteristic than there are displayed representations of the "low value" characteristic and that there are not three more displayed representations of the "low value" characteristic than there are displayed representations of the "high value" characteristic. Put differently, the gaming system determines that the difference between the counters is not equal to three. Thus, the gaming system provides another spin of the reels. The gaming system displays the following message in message box 360: "CONGRATULATIONS, YOU WIN AN AWARD OF 1,000 CREDITS FOR THE 7 7 7 WINNING SYMBOL COMBINATION! A REPRESENTATION OF THE HIGH VALUE CHARACTERISTIC IS ADDED TO THE RIGHT SIDE OF THE SCALE. SPIN AGAIN!"

Figure 3C:
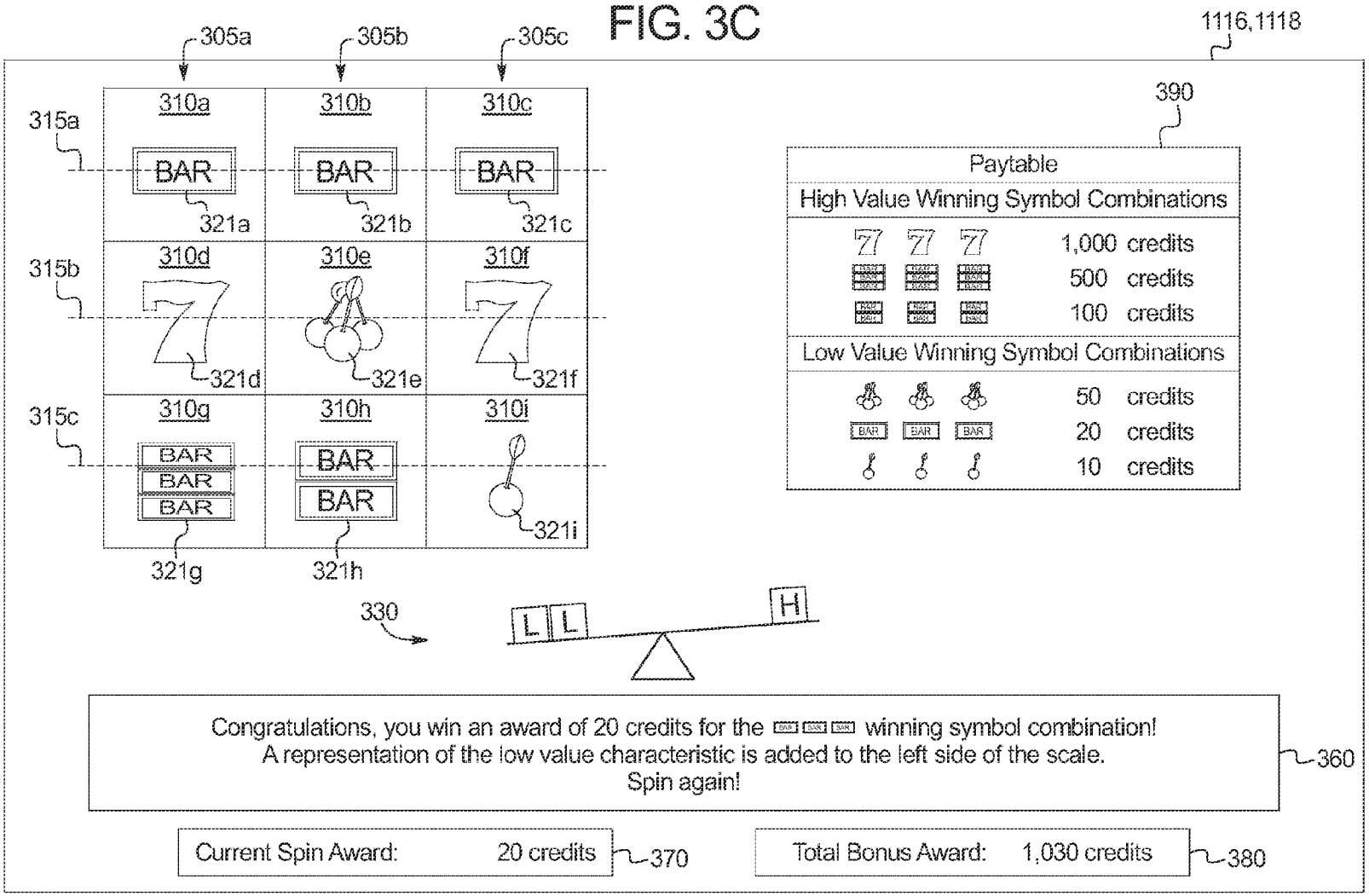

FIG. 3C illustrates a screen shot of the gaming system at a subsequent point in time during the bonus gaming session. More specifically, at this point in time, the gaming system has provided one additional play of the slot game that resulted in one instance of the "low value" Cherry-Cherry-Cherry winning symbol combination being displayed at the symbol display areas associated with one of the paylines. Accordingly, the gaming system displayed a representation of the "low value" characteristic on the left side of scale 330. In other words, the gaming system increased the counter associated with the "low value" characteristic by one. The gaming system determined that there were not three more displayed representations of the "high value" characteristic than there were displayed representations of the "low value" characteristic and that there were not three more displayed representations of the "low value" characteristic than there were displayed representations of the "high value" characteristic. Put differently, the gaming system determined that the difference between the counters was not equal to three.

Thus, the gaming system provides another play of the slot game in which the gaming system spins and stops the reels to provide an outcome. More specifically, the gaming system spins and stops the reels such that: Bar symbol 321*a* is displayed at symbol display area 310*a*, Bar symbol 321*b* is displayed at symbol display area 310*b*, Bar symbol 321*c* is displayed at symbol display area 310*c*, Seven symbol 321*d* is displayed at symbol display area 310*d*, Triple Cherry symbol 321*e* is displayed at symbol display area 310*e*, Seven symbol 321*f* is displayed at symbol display area 310*f*, Triple Bar symbol 321*g* is displayed at symbol display area 310*g*, Double Bar symbol 321*h* is displayed at symbol display area 310*h*, and Cherry symbol 321*i* is displayed at symbol display area 310*i*.

The gaming system makes an award determination based on the displayed outcome and, more specifically, determines whether any of the symbols displayed at the symbol display areas associated with any of paylines 315*a*, 315*b*, and 315*c* form any of the winning symbol combinations. The gaming system determines that Bar symbol 321*a*, Bar symbol 321*b*, and Bar symbol 321*c*, which are respectively displayed at symbol display areas 310*a*, 310*b*, and 310*c* associated with payline 315*a*, form the "low value" Bar-Bar-Bar winning symbol combination. Accordingly, the gaming system displays the 20 credit award associated with the displayed Bar-Bar-Bar winning symbol combination in current spin award meter 370 and updates total bonus award meter 380 to reflect the 20 credit award. Since the displayed Bar-Bar-Bar winning symbol combination is a "low value" winning symbol combination, the gaming system determines that the outcome of this play of the slot game is associated with the "low value" characteristic.

Because the outcome of this play of the game includes one "low value" winning symbol combination, the gaming system displays a representation of the "low value" characteristic on the left side of scale 330 and displays a corresponding tilt of scale 330 to the left. In other words, the gaming system increases the counter associated with the "low value" characteristic by one. The gaming system determines that there are not three more displayed representations of the "high value" characteristic than there are displayed representations of the "low value" characteristic and that there are not three more displayed representations of the "low value" characteristic than there are displayed representations of the "high value" characteristic. Put differently, the gaming system determines that the difference between the counters is not equal to three. Thus, the gaming system provides another spin of the reels. The gaming system displays the following message in message box 360: "CONGRATULATIONS, YOU WIN AN AWARD OF 20 CREDITS FOR THE BAR BAR BAR WINNING SYMBOL COMBINATION! A REPRESENTATION OF THE LOW VALUE CHARACTERISTIC IS ADDED TO THE LEFT SIDE OF THE SCALE. SPIN AGAIN!"

Figure 3D:
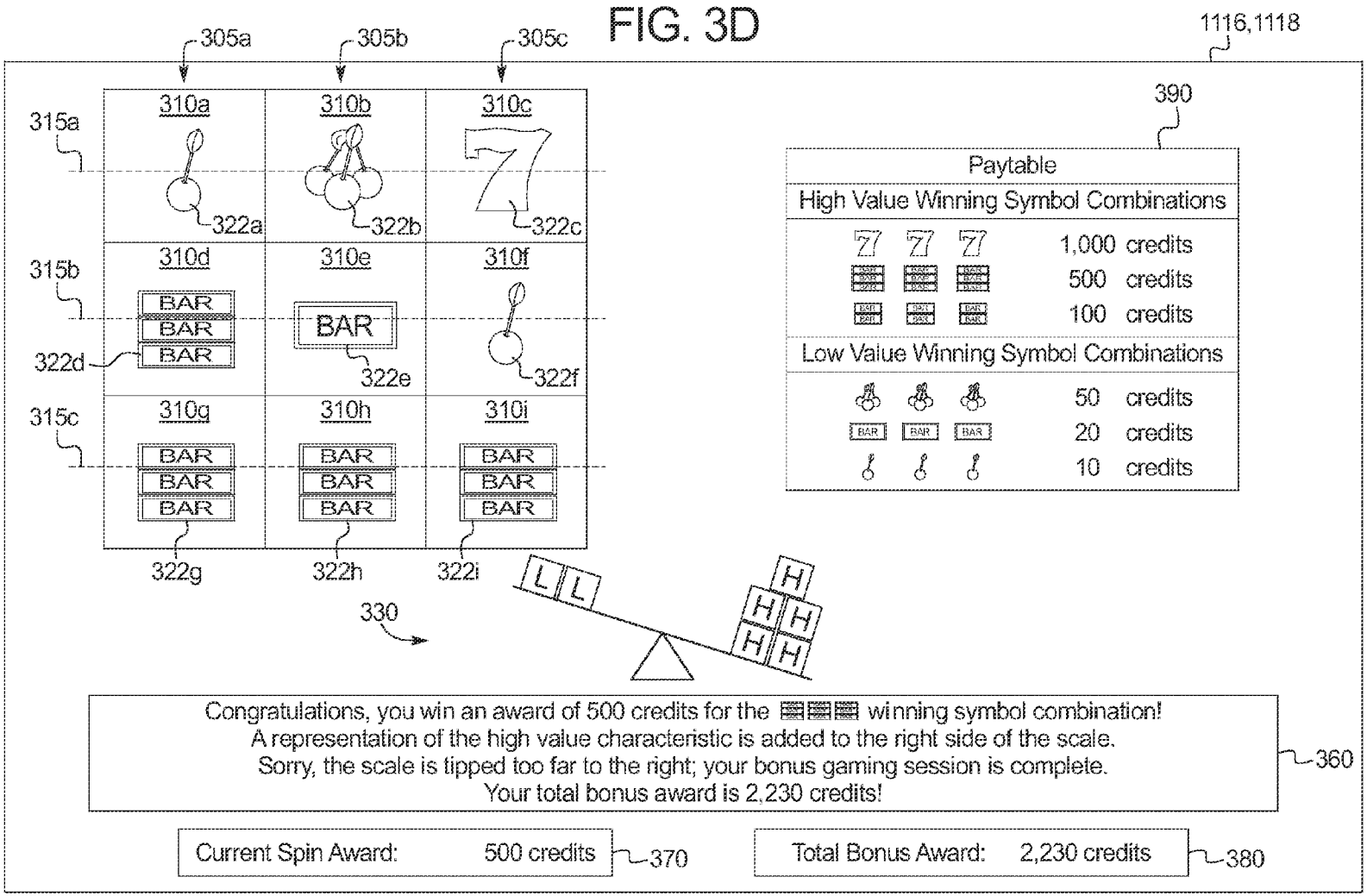

FIG. 3D illustrates a screen shot of the gaming system at a subsequent point in time during the bonus gaming session. More specifically, at this point in time, the gaming system has provided three additional plays of the slot game that resulted in one instance of the "high value" Triple Bar-Triple Bar-Triple Bar winning symbol combination being displayed at the symbol display areas associated with one of the paylines and two instances of the "high value" Double Bar-Double Bar-Double Bar winning symbol combination displayed at the symbol display areas associated with two of the paylines. Accordingly, the gaming system displayed three representations of the "high value" characteristic on the right side of scale 330. In other words, the gaming system increased the counter associated with the "high value" characteristic by three. The gaming system determined that there were not three more displayed representations of the "high value" characteristic than there were displayed representations of the "low value" characteristic and that there were not three more displayed representations of the "low value" characteristic than there were displayed representations of the "high value" characteristic. Put differently, the gaming system determined that the difference between the counters was not equal to three.

Thus, the gaming system provides another play of the slot game in which the gaming system spins and stops the reels to provide an outcome. More specifically, the gaming system spins and stops the reels such that: Cherry symbol 322*a* is displayed at symbol display area 310*a*, Triple Cherry symbol 322*b* is displayed at symbol display area 310*b*, Seven symbol 322*c* is displayed at symbol display area 310*c* Triple Bar symbol 322*d* is displayed at symbol display area 310*d*, Bar symbol 322*e* is displayed at symbol display area 310*e*, Cherry symbol 322*f* is displayed at symbol display area 310*f*, Triple Bar symbol 322*g* is displayed at symbol display area 310*g*, Triple Bar symbol 322*h* is displayed at symbol display area 310*h*, and Triple Bar symbol 322*i* is displayed at symbol display area 310*i*.

The gaming system makes an award determination based on the displayed outcome and, more specifically, determines whether any of the symbols displayed at the symbol display areas associated with any of paylines 315*a*, 315*b*, and 315*c* form any of the winning symbol combinations. The gaming system determines that Triple Bar symbol 322*g*, Triple Bar symbol 322*h*, and Triple Bar symbol 322*i*, which are respectively displayed at symbol display areas 310*g*, 310*h*, and 310*i* associated with payline 315*c*, form the "high value" Triple Bar-Triple Bar-Triple Bar winning symbol combination. Accordingly, the gaming system displays the 500 credit award associated with the displayed Triple Bar-Triple Bar-Triple Bar whining symbol combination in current spin award meter 370 and updates total bonus award meter 380 to reflect the 500 credit award. Since the displayed Triple Bar-Triple Bar-Triple Bar winning symbol combination is a "high value" winning symbol combination, the gaming system determines that the outcome of this play of the slot game is associated with the "high value" characteristic.

Because the outcome of this play of the game includes one "high value" winning symbol combination, the gaming system displays a representation of the "high value" characteristic on the right side of scale 330 and displays a corresponding tilt of scale 330 to the right. In other words, the gaming system increases the counter associated with the "high value" characteristic by one. The gaming system determines that there are three more displayed representations of the "high value" characteristic than there are displayed representations of the "low value" characteristic. Put differently, the gaming system determines that the difference between the counters is equal to three. Therefore, the gaming system ends the bonus gaming session. The gaming system displays the following message in message box 360: "CONGRATULATIONS, YOU WIN AN AWARD OF 500 CREDITS FOR THE TRIPLE BAR TRIPLE BAR TRIPLE BAR WINNING SYMBOL COMBINATION! A REPRESENTATION OF THE HIGH VALUE CHARACTERISTIC IS ADDED TO THE RIGHT SIDE OF THE SCALE. SORRY, THE SCALE IS TIPPED TOO FAR TO THE RIGHT; YOUR BONUS GAMING SESSION IS COMPLETE. YOUR TOTAL BONUS AWARD IS 2230 CREDITS!"

It should be appreciated that any suitable characteristics may be employed. For instance, in various embodiments, each characteristic is: (a) one of a plurality of different colors; (b) one of a plurality of different shapes; (c) one of a plurality of different suits (e.g., hearts, spades, diamonds, and clubs); (d) one of a plurality of different letters; (e) one of a plurality of different symbols; (f) one of a plurality of different images; (g) one of a plurality of different values or groups of values; (h) an odd or even numbered play; (i) one of a plurality of different sounds; (j) one of a plurality of different kinds of tactile feedback (such as one of a plurality of different vibration patterns); and/or (k) either winning or non-winning (e.g., winning outcomes are associated with the winning characteristic and non-winning outcomes are associated with the non-winning characteristic).

In one embodiment in which the gaming system is associated with at least three characteristics, if the difference between the counters of each of a first designated quantity of at least two of the sets of characteristics is at least a second designated quantity, the gaming system ends the gaming session. For example, the gaming system is associated with the characteristics "X," "O," and "A." In this example, the gaming system ends the gaming session if the difference between each at least two of: (a) the "X" counter and the "O" counter, (b) the "O" counter and the "A" counter, and (c) the "X" counter and the "A" counter is at least three. It should be appreciated that the first and second designated quantities may be any suitable quantities.

In one embodiment, the gaming system provides any awards upon completion of the gaming session rather than as each outcome is displayed. In this embodiment, when the gaming system determines that the displayed outcomes associated with a first one of the characteristics outnumber the displayed outcomes associated with a second one of the characteristics by the designated quantity, the gaming system only provides the awards for the displayed outcomes associated with the first one of the characteristics. Put differently, the gaming system provides the awards for the displayed outcomes associated with the first one of the characteristics and does not provide the awards for any displayed outcomes not associated with the first one of the characteristics.

In the example embodiments described above with respect to FIGS. 2A to 2D and 3A to 3D, when the gaming system displays an outcome associated with one of the characteristics, the gaming system increases the counter associated with that characteristic by one. That is, in these embodiments, each outcome is weighted the same. In other embodiments, different outcomes have weights greater than one such that when the gaming system displays one of those outcomes, the gaming system increases the counter associated with that outcome by more than one. Thus, in these embodiments, at least two outcomes are weighted differently. In one such embodiment, outcomes associated with relatively high awards have greater weights than outcomes associated with relatively low awards. For example, an outcome associated with an award of 300 credits has a weight of three, which is greater than the weight of one associated with an award of 100 credits. In another example, each outcome is associated with a weight that is equal to the award associated with that outcome. In further embodiments, different outcomes have negative weights such that, when such an outcome occurs, the gaming system decreases the counter associated with the characteristic associated with that outcome.

In the example embodiments described above with respect to FIGS. 2A to 2D and 3A to 3D, each of the outcomes is associated with one of the two characteristics (i.e., either an "X" or an "O" or a "high value" or a "low value"). In other embodiments, however, at least one of the outcomes is not associated with any of the characteristics. In further embodiments, at least one of the outcomes is associated with each of the characteristics. In other embodiments including three or more characteristics, at least one of the outcomes is associated with each of a plurality of, but less than all of, the characteristics. In certain embodiments in which an outcome is associated with each of a plurality of the characteristics, a different weight may be assigned to each characteristic.

In one embodiment, each outcome is associated with an "even" or "odd characteristic. In this embodiment, the gaming system associates the "odd" characteristic with every outcome of an odd-numbered play of the game during the gaming session (i.e., plays 1, 3, 5, 7, and so on). Conversely, the gaming system associates the "even" characteristic with every outcome of an even-numbered play of the game during the gaming session (i.e., plays 2, 4, 6, 8, and so on). The gaming system associates weights with each of the outcomes based on the awards associated with the outcomes. It should thus be appreciated that, in this embodiment, the player is incentivized to achieve outcomes having similar awards so as to minimize the difference between the counters associated with the "even" and "odd" characteristics.

in the example embodiment described above with respect to FIGS. 3A to 3D, the gaming system determines whether an outcome of the slot game is associated with the "high value" characteristic, the "low value" characteristic, or both based on any displayed winning symbol combinations. In other embodiments, displayed scatter symbols (or scatter sub-symbols) affect whether an outcome is associated with the "high value" characteristic, the "low value" characteristic, or both. In one example, the symbols on the reels include "high value" scatter symbols and "low value" scatter symbols. In this example, when a displayed outcome of the slot game includes a "high value" scatter symbol, the gaming system increases the counter associated with the "high value" characteristic by one, and when the displayed outcome of the slot game includes a "low value" scatter symbol, the gaming system increases the counter associated with the "low value" characteristic by one. In one variation, the gaming system provides an award based on the total quantity of scatter symbols generated and displayed during the gaming session.

In one embodiment, the gaming system limits the gaming session to a maximum number of games. That is, in this embodiment, the gaming system ends the gaming session when one of: (a) the maximum number of games have been provided; and (b) the displayed outcomes associated with a first one of the characteristics outnumber the displayed outcomes associated with a second one of the characteristics by the designated quantity. The gaming system provides an additional award if the gaming system ends the gaming session because the maximum number of games have been provided.

In other embodiments, the gaming system only ends the gaming session when the displayed outcomes associated with a first one of the characteristics outnumber the displayed outcomes associated with the second one of the characteristics by a designated quantity, which may be any suitable amount, such as two, three, four, five, and the like.

In certain embodiments, the gaming system provides an additional award based on how balanced the counters are at one or more designated points in time (e.g., upon completion of the bonus). In one such embodiment, the gaming system provides a first additional award if the counters are the same (e.g., the counter associated with the "X" reads ten and the counter associated with the "O" reads ten) and a second additional award if the counters are not the same, but within a designated number of one another (e.g., the counters are within two of one another).

In certain embodiments, the gaming system provides one or more counter modification events that, when provided, modify one or more of the counters. In certain instances, the gaming system provides the counter modification events independent of any outcomes associated with the characteristics. In one embodiment, the counter modification event causes the gaming system to increase the counter associated with at least one of the characteristics. In another embodiment, the counter modification event causes the gaming system to decrease the counter associated with at least one of the characteristics. In another embodiment, the counter modification event causes the gaming system to equalize the counters associated with at least two of the characteristics. In another embodiment, the counter modification event causes the gaming system to increase the counter associated with at least one of the characteristics and decrease the counter associated with at least one of the characteristics. In one embodiment, the gaming system modifies the counter(s) upon the occurrence of the counter modification event if such modification will not cause the gaming system to end the gaming session.

In another embodiment, the game is an offer/acceptance game. In this embodiment, for each play of the offer/acceptance game, the gaming system displays a plurality of different offers, each of which is associated with an award and at least one of a plurality of different characteristics. The gaming system enables the player to accept one of the offers. When the gaming system receives a selection of one of the offers, the gaming system provides the award associated with the accepted offer to the player and increases the counter associated with the characteristic associated with the accepted offer. For example, for a play of the offer/acceptance game, the gaming system displays the following three offers: 100 Blue, 500 Red, and 200 Red, and enables the player to accept one of the offers. In this example, higher awards are associated with higher weights such that acceptance of the 500 Red offer would cause the gaming system to increase the counter associated with the Red characteristic more than if the 200 Red offer was accepted.

In certain embodiments, the gaming system includes a plurality of electronic gaming machines (EGMs) and provides a community gaming session for players of those EGMs. In one such embodiment, the gaming system assigns each player to one of a plurality of different teams. In this embodiment, the teams are the characteristics such that for each player, for each play of the game, the outcome of that play of the game is associated with that player's team. Thus, for each player, for each play of the game, when the outcome of a play of the game is displayed, the gaming system increases the counter associated with that player's team. Upon completion of the bonus gaming session, the gaming system provides each player the sum of the awards for the outcomes associated with that player's team. In one variation, if the gaming system ends the gaming session because a maximum number of games have been provided, the gaming system provides each of the players with the awards for the outcomes associated with each of the teams.

It should be appreciated that, in different embodiments, one or more of:

(1) the quantity of characteristics,
(2) the designated quantity by which the counters must differ before the gaming system ends the gaming session,
(3) the occurrence of one or more counter modification events (if any),
(4) the maximum number of games (if any),
(5) the game,
(6) the quantity of teams (in group gaming embodiments),
(7) the quantity of outcomes associated with each characteristic,
(8) which outcomes are associated with each characteristic,
(9) the quantity of outcomes associated with no characteristic (if any),
(10) the quantity of outcomes associated with multiple characteristics (if any),
(11) the quantity of outcomes associated with different weights (if any),
(12) the weights associated with the outcomes (if any),
(13) the type of award associated with each outcome (if any),
(14) the value of the award associated with each outcome (if any),
(15) any determination disclosed herein,
(16) which characteristics are employed,
(17) which type of counter is employed,
(18) the paytable used,
(19) the winning symbol combinations in the paytable, and
(20) a maximum award is/are: (1) predetermined; (2) randomly determined; (3) randomly determined based on one or more weighted percentages; (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an electronic gaming machine (EGM) configured to operate the slot game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager; (17) determined independent of the player's primary game wager; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (e.g., a player tracking status); (23) determined independent of a status of the player (e.g., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems such as, but not limited those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or a) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
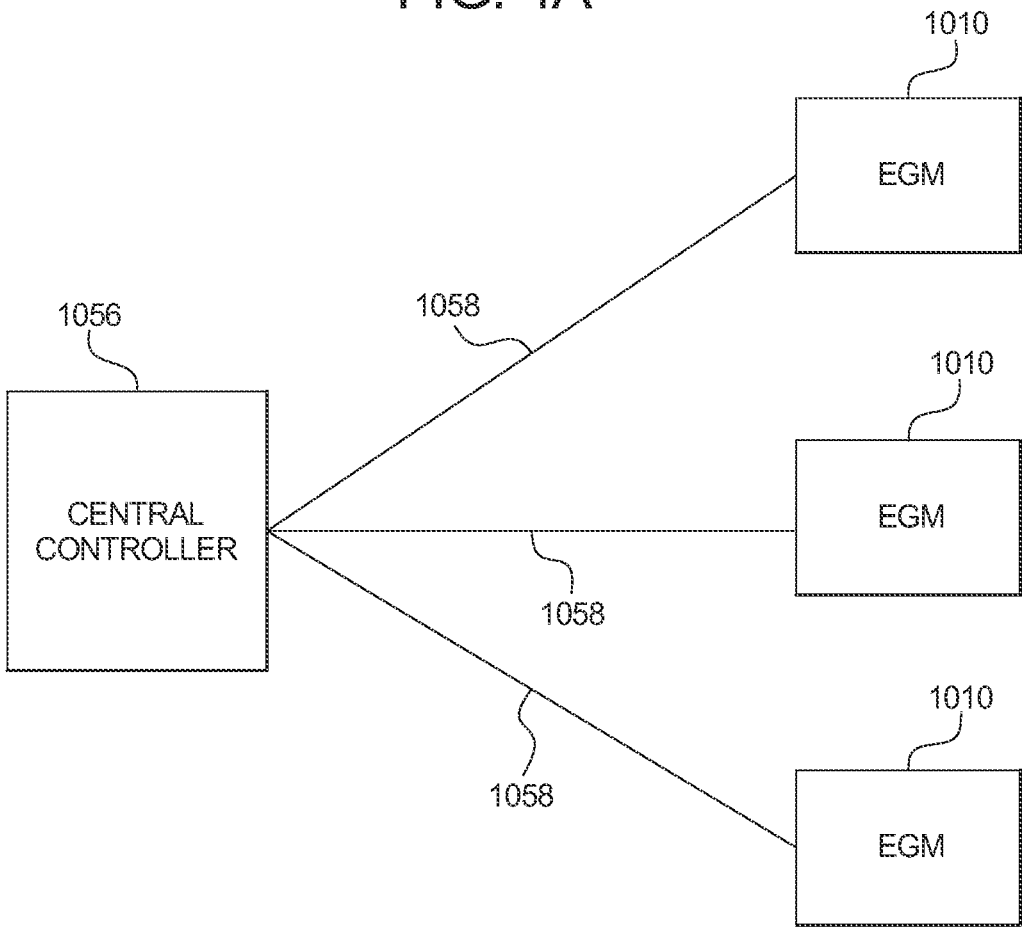
FIG. 4A is a schematic block diagram of an example network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
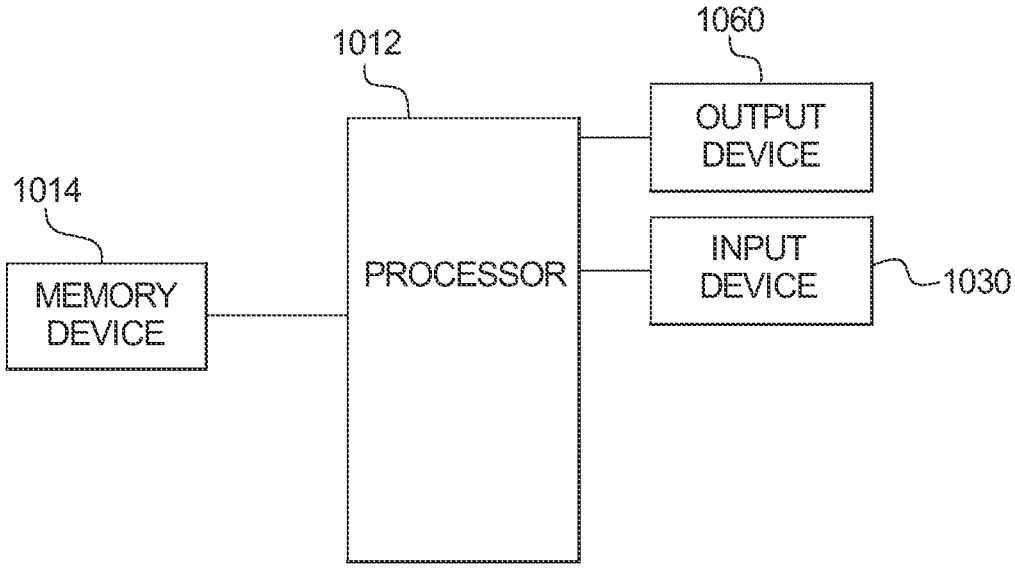
FIG. 4B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
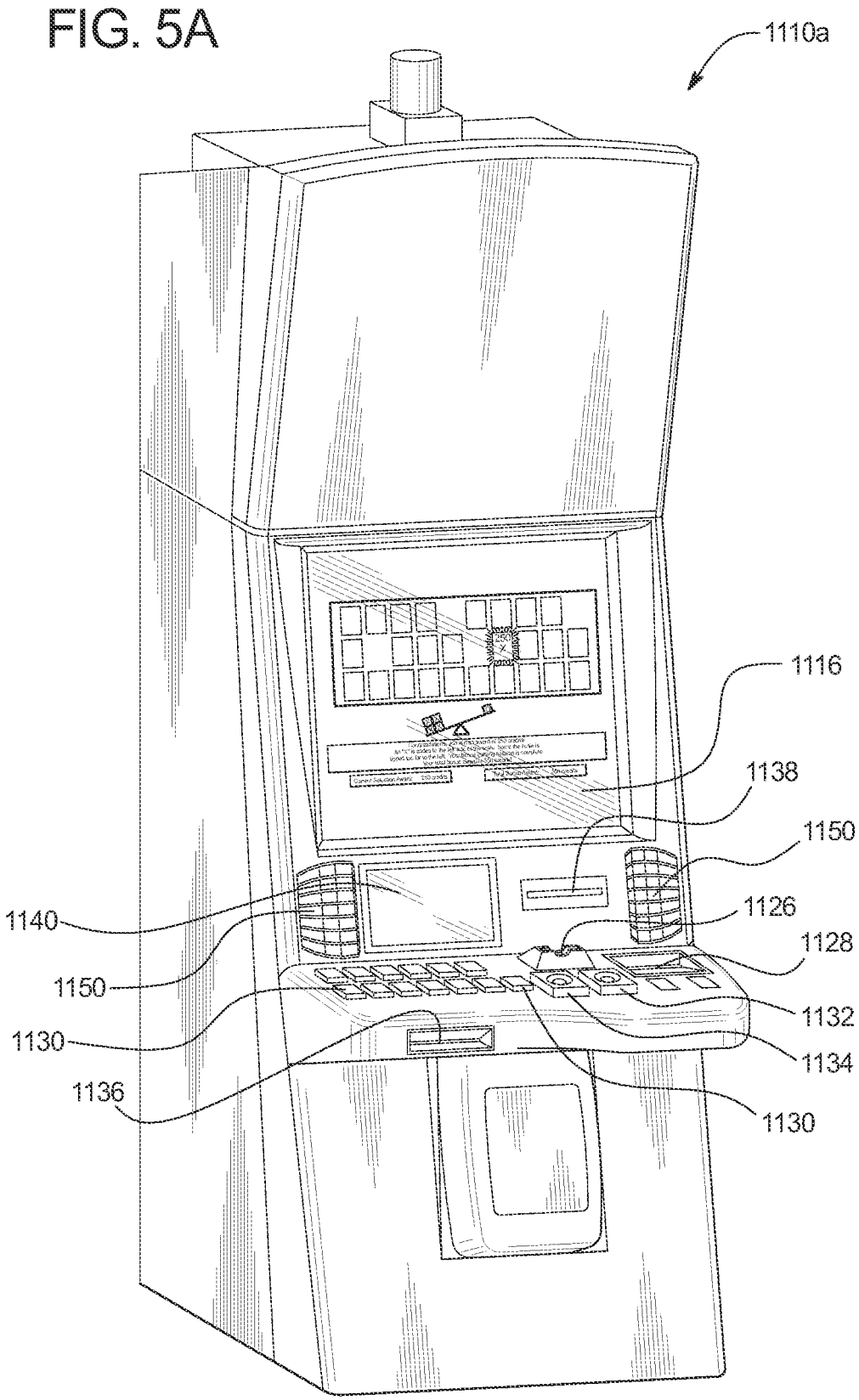
FIGS. 5A and 5B are perspective views of example alternative embodiments of the gaming system of the present disclosure.
Figure 5B:
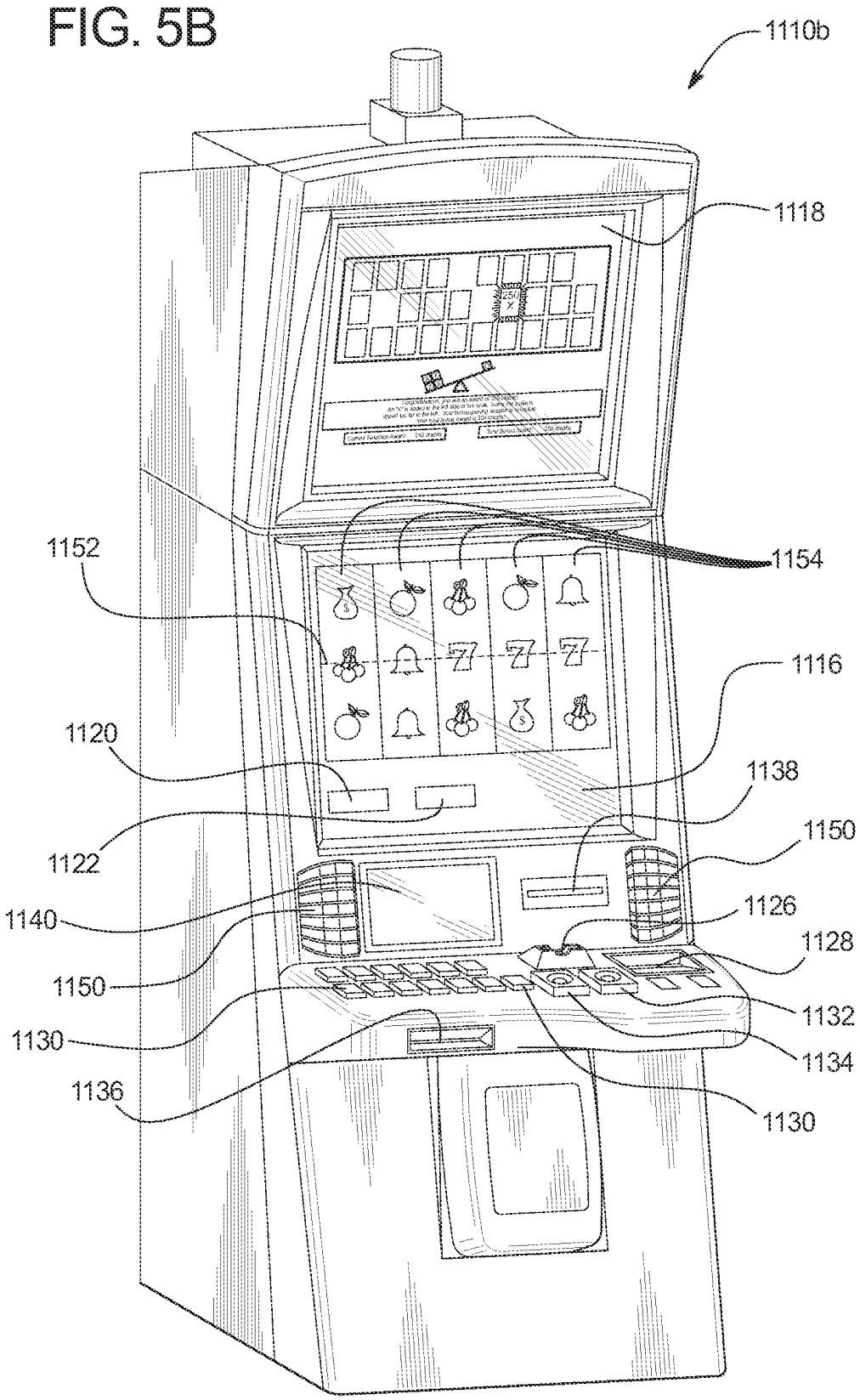

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example. EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 5B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM shown in FIG. 5B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor;

at least one display device;

at least one input device; and at least one memory device storing a plurality of instructions which, when executed by the at least one processor, cause the at least one processor to operate with the at least one display device and the at least one input device, for a gaming session, to:

(a) for a play of a game, determine and display one of a plurality of different outcomes, each of at least two of the outcomes being associated with at least one of a plurality of different characteristics, each of the characteristics being associated with a separate counter;

(b) display any awards associated with said displayed outcome;

(c) for each characteristic, if any, associated with said displayed outcome, increase the separate counter associated with said characteristic;

(d) for each set of two of the separate counters, determine a difference between the separate counters of said set of the separate counters;

(e) if the difference between the separate counters of any of the sets of the separate counters is at least a designated quantity, end said gaming session; and (f) if none of the differences between the separate counters of any of the sets of the separate counters are at least the designated quantity, repeat (a) to (f).

2. The gaming system of claim 1, wherein the plurality of instructions, when executed by the at least one processor, cause the at least one processor to end said gaming session when a maximum quantity of plays of the game have been provided.

3. The gaming system of claim 2, wherein the plurality of instructions, when executed by the at least one processor, cause the at least one processor to, if the maximum quantity of plays of the game have been provided, provide an additional award.

4. The gaming system of claim 1, wherein the game is a selection game and the plurality of instructions, when executed by the at least one processor, cause the at least one processor to operate with the at least one input device and the at least one display device to, for said play of the game, receive a pick of one of a plurality of different selections and determine and display the outcome based on the picked selection.

5. The gaming system of claim 4, wherein each of the selections is associated with one of the characteristics.

6. The gaming system of claim 1, wherein the game is a slot game, the displayed outcome includes a plurality of symbols, and the plurality of instructions, when executed by the at least one processor, cause the at least one processor to determine with which of the characteristics the displayed outcome is associated based on whether the displayed symbols form any of a plurality of different winning symbol combinations.

7. The gaming system of claim 1, wherein the characteristic with which the displayed outcome is associated is based on an order in which said play of the game occurred relative to other plays of the game during said gaming session.

8. The gaming system of claim 1, wherein each separate counter is displayed.

9. A gaming system comprising:

a plurality of gaming devices each including:

(a) at least one processor;

(b) at least one display device;

(c) at least one input device; and (d) at least one memory device storing a plurality of instructions which, when executed by the at least one processor, cause the at least one processor to operate with the at least one display device and the at least one input device; and a controller configured to operate with the gaming devices to, for a gaming session:

(a) assign each of the gaming devices to one of a plurality of different teams, each of the teams being associated with a separate counter;

(b) enable players of the gaming devices to play a game;

(c) for each of the gaming devices, for each play of the game on said gaming device:

(i) determine and display one of a plurality of different outcomes, (ii) display any awards associated with said displayed outcome, and (iii) increase the separate counter associated with the team to which said gaming device is assigned;

(d) for each set of two of the separate counters, determine a difference between the separate counters of said set of the separate counters; and (e) when the difference between the separate counters of any of the sets of the separate counters is at least a designated quantity, end said gaming session.

10. The gaming system of claim 9, wherein the controller is configured to operate with the gaming devices to, when the difference between the separate counters of any of the sets of the separate counters is at least the designated quantity, for each of the teams, provide each of the players of the gaming devices assigned to said team with the determined awards for each of the plays of the game conducted on each of the gaming devices assigned to said team.

11. The gaming system of claim 9, wherein the controller is configured to operate with the gaming devices to end said gaming session when a maximum quantity of plays of the game have been provided.

12. The gaming system of claim 11, wherein the controller is configured to operate with the gaming devices to, if the maximum quantity of plays of the game have been provided, for each of the teams, provide each of the players of the gaming devices assigned to said team with the determined awards for each of the plays of the game conducted on each of the gaming devices.

13. The gaming system of claim 9, wherein each separate counter is displayed.

14. A method of operating a gaming system, said method comprising:

for a gaming session:

(a) causing at least one processor to execute a plurality of instructions stored in at least one memory device to, for a play of a game, determine one of a plurality of different outcomes, each of at least two of the outcomes being associated with at least one of a plurality of different characteristics, each of the characteristics being associated with a separate counter;

(b) causing the at least one processor to execute the plurality of instructions to operate with at least one display device to display the determined outcome;

(c) causing the at least one processor to execute the plurality of instructions to operate with the at least one display device to display any awards associated with said displayed outcome;

(d) causing the at least one processor to execute the plurality of instructions to, for each characteristic, if any, associated with said displayed outcome, increase the separate counter associated with said characteristic;

(e) causing the at least one processor to execute the plurality of instructions to, for each set of two of the separate counters, determine a difference between the separate counters of said set of the separate counters;

(f) causing the at least one processor to execute the plurality of instructions to, if the difference between the separate counters of any of the sets of the separate counters is at least a designated quantity, end said gaming session; and (g) if none of the differences between the separate counters of any of the sets of the separate counters are at least the designated quantity, repeating (a) to (g).

15. The method of claim 14, which includes causing the at least one processor to execute the plurality of instructions to end said gaming session when a maximum quantity of plays of the game have been provided.

16. The method of claim 15, which includes, if the maximum quantity of plays of the game have been provided, providing an additional award.

17. The method of claim 14, wherein the game is a selection game, and which includes causing the at least one processor to execute the plurality of instructions to operate with at least one input device and the at least one display device to, for said play of the game, receive a pick of one of a plurality of different selections and determine and display the outcome based on the picked selection.

18. The method of claim 17, wherein each of the selections is associated with one of the characteristics.

19. The method of claim 14, wherein the game is a slot game and the displayed outcome includes a plurality of symbols, and which includes causing the at least one processor to execute the plurality of instructions to determine with which of the characteristics the displayed outcome is associated based on whether the displayed symbols form any of a plurality of different winning symbol combinations.

20. The method of claim 14, wherein the characteristic with which the displayed outcome is associated is based on an order in which said play of the game occurred relative to other plays of the game during said gaming session.

21. The method of claim 14, wherein each separate counter is displayed.

22. The method of claim 14, which is provided through a data network.

23. The method of claim 22, wherein the data network is an internet.

24. A method of operating a gaming system, said method comprising:

causing a controller to operate with a plurality of gaming devices to, for a gaming session:

(a) assign each of the gaming devices to one of a plurality of different teams, each of the teams being associated with a separate counter;

(b) enable players of the gaming devices to play a game;

(c) for each of the gaming devices, for each play of the game on said gaming device:

(i) determine and cause at least one display device to display one of a plurality of different outcomes, (ii) cause the at least one display device to display any awards associated with said displayed outcome, and (iii) increase the separate counter associated with the team to which said gaming device is assigned;

(d) for each set of two of the separate counters, determine a difference between the separate counters of said set of the separate counters; and (e) when the difference between the separate counters of any of the sets of the separate counters is at least a designated quantity, end said gaming session.

25. The method of claim 24, which includes causing the controller to operate with the gaming devices to, when the difference between the separate counters of any of the sets of the separate counters is at least the designated quantity, for each of the teams, provide each of the players of the gaming devices assigned to said team with the determined awards for each of the plays of the game conducted on each of the gaming devices assigned to said team.

26. The method of claim 24, which includes causing the controller to operate with the gaming devices to end said gaming session when a maximum quantity of plays of the game have been provided.

27. The method of claim 26, which includes causing the controller to operate with the gaming devices to, if the maximum quantity of plays of the game have been provided, for each of the teams, provide each of the players of the gaming devices assigned to said team with the determined awards for each of the plays of the game conducted on each of the gaming devices.

28. The method of claim 24, wherein each separate counter is displayed.

29. The method of claim 24, which is provided through a data network.

30. The method of claim 29, wherein the data network is an internet.

* * * * *